US008403368B2

(12) United States Patent
Tompkin et al.

(10) Patent No.: US 8,403,368 B2
(45) Date of Patent: Mar. 26, 2013

(54) SECURITY DOCUMENT

(75) Inventors: Wayne Robert Tompkin, Baden (CH); Andreas Schilling, Hagendorn (CH); Rene Staub, Hagendorn (CH)

(73) Assignee: Leonhard Kurz Stiftung & Co. KG, Furth (DE)

( * ) Notice: Subject to any disclaimer, the term of this patent is extended or adjusted under 35 U.S.C. 154(b) by 809 days.

(21) Appl. No.: 12/449,459

(22) PCT Filed: Feb. 7, 2008

(86) PCT No.: PCT/EP2008/000924

§ 371 (c)(1), (2), (4) Date: Sep. 25, 2009

(87) PCT Pub. No.: WO2008/095696

PCT Pub. Date: Aug. 14, 2008

(65) Prior Publication Data

US 2010/0001508 A1 Jan. 7, 2010

(30) Foreign Application Priority Data

Feb. 7, 2007 (DE) ..... 10 2007 005 884

(51) Int. Cl.
*B42D 15/00* (2006.01)
*B42D 15/10* (2006.01)

(52) U.S. Cl. ..... 283/113; 283/72; 283/74; 283/82; 283/83; 283/91; 283/94; 283/98; 283/109; 283/110

(58) Field of Classification Search ..... 283/67, 283/72, 74, 82, 83, 91, 94, 98, 109, 110, 283/113

See application file for complete search history.

(56) References Cited

U.S. PATENT DOCUMENTS

| | | | | |
|---|---|---|---|---|
| 5,449,200 | A * | 9/1995 | Andric et al. | 283/113 |
| 2002/0027361 | A1 | 3/2002 | Hardwick et al. | |
| 2003/0137145 | A1* | 7/2003 | Fell et al. | 283/72 |
| 2004/0007625 | A1 | 1/2004 | Kappe et al. | |
| 2004/0036272 | A1 | 2/2004 | Mathys | |
| 2004/0096635 | A1 | 5/2004 | Rancien | |
| 2004/0239099 | A1* | 12/2004 | Tompkin et al. | 283/74 |
| 2004/0265552 | A1 | 12/2004 | Lutz et al. | |
| 2006/0202469 | A1* | 9/2006 | Teitelbaum | 283/72 |
| 2007/0085337 | A1 | 4/2007 | Endres et al. | |
| 2008/0094713 | A1 | 4/2008 | Tompkin et al. | |

(Continued)

FOREIGN PATENT DOCUMENTS

| | | |
|---|---|---|
| DE | 19739193 | 3/1999 |
| DE | 10047450 | 4/2002 |

(Continued)

*Primary Examiner* — Dana Ross
*Assistant Examiner* — Justin V Lewis
(74) *Attorney, Agent, or Firm* — Hoffman & Baron, LLP

(57) ABSTRACT

The invention concerns a security document comprising a translucent carrier substrate, in particular of paper and/or plastic material, and at least one security element which is applied to the carrier substrate or embedded in the carrier substrate and which presents at least one image when viewed in the transillumination mode from at least a first side of the security document and simulates a presence of at least a first watermark in the carrier substrate, wherein the security element has at least region-wise at least one layer which simulates the first watermark, wherein the at least one layer of the security element, that simulates the first watermark, imparts thereto unexpected optical effects in relation to security elements with conventional watermarks.

44 Claims, 13 Drawing Sheets

U.S. PATENT DOCUMENTS

| | | | |
|---|---|---|---|
| 2008/0143095 | A1 | 6/2008 | Isherwood et al. |
| 2008/0160226 | A1 | 7/2008 | Kaule et al. |

FOREIGN PATENT DOCUMENTS

| | | | |
|---|---|---|---|
| DE | 10154051 | | 6/2002 |
| DE | 10256832 | | 6/2004 |
| DE | 1020004042136 | | 3/2006 |
| EP | 0628408 | | 12/1994 |
| EP | 1 291 827 | A1 | 3/2003 |
| WO | 9913157 | | 3/1999 |
| WO | WO9913157 | | 3/1999 |
| WO | WO20005106118 | | 11/2004 |
| WO | 2005038136 | | 4/2005 |
| WO | 2005053968 | | 6/2005 |
| WO | 2006087138 | | 8/2006 |
| WO | 2008095696 | | 8/2008 |

* cited by examiner

A - A'

B - B'

D - D'

SECURITY DOCUMENT

This application claims priority based on an International Application filed under the Patent Cooperation Treaty, PCT/EP2008/000924, filed on Feb. 7, 2008 and German Application No. DE 102007005884.7-45, filed on Feb. 7, 2007.

BACKGROUND OF THE INVENTION

The invention concerns a security document comprising a translucent carrier substrate, in particular of paper and/or plastic material, and at least one security element which is applied to the carrier substrate or embedded in the carrier substrate and which presents at least one image when viewed in the transillumination mode from at least a first side of the security document and simulates a presence of at least a first watermark in the carrier substrate, wherein the security element has at least region-wise at least one layer which simulates the at least one first watermark and which locally alters the visually perceptible translucence of the carrier substrate.

Such security documents are known from WO 99/13157 A1. Here, a security film is applied to or integrated into a value-bearing paper or bond, as a security element. The security film comprises a translucent carrier film and a metallic coating which applied thereto and which has metal-free regions which are to be clearly recognised in particular in a transillumination mode. The metallic coating is divided into individual raster points producing a half-tone image. If the security film is embedded between two layers of a security paper, the presence of a watermark is simulated in the security paper by the metallic coating, and the watermark can be clearly perceived in the transillumination mode.

A conventional watermark in paper is produced by the thickness of the paper being locally altered in the manufacture thereof so that there are differences in transmission in the paper. In the transillumination mode, a continuous grey scale image, referred to as the watermark, can be perceived by a viewer from both sides of the paper.

Simulation of a watermark by a security element has the advantage that the complicated and expensive production process, as is required with conventional watermark formation on paper substrates, can be avoided. In addition, by means of a simulated watermark, it is also possible for a translucent plastic substrate to be easily provided with a watermark effect. Only embedding or applying a security element formed independently of the translucent carrier substrate of the security document, in or to the translucent carrier substrate, whether now it is of paper, plastic material, or also Teslin®, or laminates of those materials, is required. In that respect, depending on the respective configuration of the security element, a wide range of different watermarks can be simulated in one and the same carrier substrate.

It has been found however that the simulation of watermarks by means of separate security elements on a security document can also be performed by a forger at a viable level of complication and effort. For that purpose for example an imprint is arranged or a mask layer is glued in place between the paper layers to simulate the desired grey scale image.

SUMMARY OF THE INVENTION

Therefore the object of the invention is to provide a security document which has a watermark effect which can be particularly difficult to imitate and which is simulated by a security element.

That object is attained for the security document comprising a translucent carrier substrate and at least one security element which is applied to the carrier substrate or embedded in the carrier substrate and which presents at least one image when viewed in the transillumination mode from at least a first side of the security document and simulates a presence of at least a first watermark in the carrier substrate, wherein the security element has at least region-wise at least one layer which simulates the at least one first watermark, in that the at least one security element applied to the carrier substrate or embedded in the carrier substrate visually perceptibly a) in the incident light mode shows a second image different from the first image, and/or b) in the transillumination mode shows a third image different from the first image viewed from a second side opposite to the first side, and/or c) in the transillumination mode shows at least one fourth image different from the first image when viewed from the first side or a second side opposite to the first side in dependence on viewing angle.

In that respect daylight or artificial light is usually provided as the illumination. It will be noted however that these or further optical effects can also be presented with additional ultraviolet or infrared radiation if the at least one layer simulating the first watermark contains one or more substances (such as for example luminescent, thermochromic, photochromic substances and similar) which can be excited with such a radiation.

The configuration according to the invention of the security document imparts thereto, besides a simulated watermark effect, further interesting and unexpected effects directly related to the simulated watermark.

In the case of conventional security elements which are embedded in the carrier substrate and which simulate a watermark, a viewer in the transillumination mode sees the same watermark image from both sides of the security document, only in laterally inverted form in the case of asymmetrical motifs. If the security element is applied to one side of the carrier substrate, then that layer or layers which in the transillumination mode influences or influence the transmission of the carrier substrate present themselves to the viewer, usually directly. The viewer expects in that respect that at least the shape of opaque layers corresponds to that which he perceives on the other side as a watermark, possibly in laterally inverted form. When viewing the security document according to the invention however the viewer is presented with an unexpected optical impression as the accustomed watermark effects do not occur in that fashion, or only in part.

In that respect in particular paper and/or plastic material and/or Teslin® or a composite of such materials has proven desirable as a translucent carrier substrate. In that respect the term "translucent" signifies that the carrier substrate is admittedly light-transmitting, but not clear or transparent. A volume scattering effect occurs in the carrier substrate and the light passing therethrough is scattered to a greater or lesser degree depending on the respective choice and thickness of material.

Preferably the at least one layer simulating the first watermark is provided by at least one metal layer and/or at least one dielectric layer, in particular with a high refractive index, and/or at least one chalcogenide glass layer and/or a pigmented layer, in particular a pigmented dye layer or ink, and/or a liquid crystal layer. In that respect a combination of at least one metal layer and at least one pigmented layer has proven particularly desirable.

When the security document is viewed in the incident light mode, it is assumed here that this involves viewing by a human eye under normal conditions, that is to say in daylight or artificial light, with the light being incident on the security document from the side of the viewer.

When the security document is viewed in the transillumination mode, it is assumed that this involves viewing by the human eye under normal conditions, with the light being incident on the security document from the rear side thereof, that is to say the side of the security document, that is remote from the viewer.

It has proven desirable if in case a) the layer simulating the at least one first watermark has regions of different transmissivity.

It has proven desirable in that respect if in case a) the security element is applied on the second side of the security document or is embedded in the translucent carrier substrate in such a way that the security element is disposed in a plane parallel to the first side and the second side and a region of the carrier substrate which is on the second side between the at least one layer simulating the watermark and a viewer is at least partially cut out, wherein regions, visible from the second side, of the layer simulating the first watermark are to be visually recognised in the incident light mode as closed opaque layer regions, but at least the visible regions of the layer simulating the first watermark are differently transmissive in the transillumination mode.

Thus in the case of the security document, in accordance with case a), as usual, the viewer recognises the first watermark when viewing the first side in the transillumination mode. On the second side, in the incident light mode, the viewer sees the security element applied to the carrier substrate and the at least one layer simulating the first watermark, the form of which however is not coincident with the form of the first watermark, contrary to expectation. In the transillumination mode however once again the first watermark—which is possibly laterally inverted—can also be seen from the second side. That effect is achieved by the at least one layer simulating the at least one first watermark being formed with regions of different transmissivity, which can be visually distinguished from each other only in the transillumination mode.

In the case of a paper or plastic material carrier substrate, the latter case, that the security element is disposed in a plane parallel to the first side and the second side of the security document and a region which is on the second side between the at least one opaque layer and a viewer is cut out can be implemented by the carrier substrate being formed from at least two layer portions and the at least one security element being arranged between those layer portions. Before the layer portions are assembled one thereof is provided with a window opening and the window opening is placed over the security element in such a way that the at least one layer which is opaque in the incident light mode is visible.

In that respect, as moreover also hereinafter in the text, the term window opening is used to denote not only an opening but also a clear or transparent region, for example of plastic material which is as clear as glass.

Alternatively a window opening can also be introduced into both layer portions and the at least one security element can be brought into overlapping relationship, with both window openings. Then the security element is covered over on the first side with at least one translucent colour layer so that the layer simulating the at least one first watermark can be perceived only from the second side.

In general however at least one translucent colour layer can also already be a constituent part of the security element so that there is no need for application after embedding of the security element in the carrier substrate. A translucent colour layer can further be formed by a translucent adhesive layer which is used when embedding the security element between the layer portions of the carrier substrate, for gluing to a layer portion. In regard to optical veiling of the presence of window openings in the carrier substrate, the integration of translucent colour layers in the security element, in combination with an additional application of translucent colour layers after embedding of the security element or use of translucent adhesive layers for embedding purposes can be advantageous.

It is further advantageous if in case a) the at least one layer simulating the watermark, when viewed in the incident light mode, presents a different surface extent than can be perceived in the transillumination mode.

It has further proven desirable if in case a) the layer simulating the first watermark is applied on the second side of the security document and is covered region-wise by at least one translucent colour layer arranged on the second side, or is embedded in the translucent carrier substrate in such a way that the security element is disposed in a plane parallel to the first side and the second side and a region of the carrier substrate which is on the second side between the at least one layer simulating the watermark and a viewer is either partially cut out or however entirely cut out and covered region-wise by at least one translucent colour layer arranged on the second side, wherein the regions, visible from the second side, of the layer simulating the first watermark are to be recognised in the incident light mode visually as opaque layer regions which are shaped out region-wise and which show an item of security information, and in the transillumination mode from the second side there shows the at least one first watermark which differs from the item of security information.

In the case of a security document in accordance with case a) a viewer also perceives as usual a first watermark when viewing the first side in the transillumination mode. On the second side, in the incident light mode, the viewer sees the security element applied to the carrier substrate or opaque regions of the layer simulating the first watermark, which regions are shaped out region-wise and show an item of security information, the form of which however is not coincident with that of the first watermark, contrary to expectation. In the transillumination mode once again the watermark—which is now possibly laterally inverted—can also be seen from the second side. That effect is achieved on the one hand in that—and this is not visible to the viewer in the incident light mode—only parts of the layer which simulates the first watermark and which is shaped out over its full area or in region-wise manner, are directly visibly arranged. In this case the layer simulating the first watermark can also have regions of different transmissivity which can be visually distinguished from each other only in the transillumination mode. On the other hand the effect can also be achieved by the at least one layer which is opaque in the incident light mode—being readily visible to the human eye—is formed only in a region-wise manner and is completely visible and in addition has regions involving different transmissivity which can be visually distinguished from each other only in the transillumination mode.

In that respect, the human viewer perceives as being opaque in the transillumination mode, a region of the layer simulating the first watermark, if the transmission for visible light is less than 5%, in particular less than 1%. In the transillumination mode, a viewer perceives as being translucent, regions involving transmission for visible light of greater than 10%, in particular greater than 20%. It will be noted that, in the incident. light mode, there can also be the impression of an opaque layer region for a viewer in the regions perceived as being translucent in the transillumination mode. If for example a metal layer is used as the layer simulating the first watermark, the regions perceived as being opaque and translucent in the transillumination mode, when viewed in the incident light mode, reflect to different degrees at a maximum by a factor of 10. Reflection differing by the factor of 10 can be clearly perceived by the human eye while a difference in reflection of up to about 20% is scarcely any longer perceptible.

If therefore the factor is selected to be as low as possible and/or the reflection characteristics of the layer simulating the first watermark are matched to those of the background, the human eye cannot resolve the differences in the incident light mode and perceives a uniformly opaque surface.

In the case of a carrier substrate of for example paper and/or plastic material, the case where the security element is embedded in the translucent carrier substrate and is disposed in a plane parallel to the first side and the second side, wherein a region of the carrier substrate disposed on the second side between the at least one layer simulating the first watermark and a viewer is at least partially cut out, can be implemented by the carrier substrate being formed from at least two layer portions and the at least one security element being arranged between those layer portions. Prior to assembly of the layer portions one thereof is provided with a window opening and the window opening is placed over the security element in such a way that the at least one layer simulating the first watermark is only partially visible. Alternatively the layer simulating the first watermark could also be completely visible and it can then be covered region-wise with the translucent colour layer. In addition it is also possible here for a window opening to be introduced into both layer portions and for the at least one security element to be brought into alignment, with the two window openings. Then the security element is partially or completely covered with a translucent colour layer on the first side and covered region-wise with the translucent colour layer on the second side so that the layer simulating the first watermark is only partially visible in the incident light mode, on the second side. The at least one layer simulating the first watermark is not to be seen on the first side, or is also only partially visible there. If the at least one layer simulating the first watermark is also to be partially seen in the incident light mode on the second side, it is preferable if different regions of the at least one layer simulating the first watermark are visible on the first side and the second side, in the incident light mode.

In general in this case also at least one transparent colour layer can already be a constituent part of the security element or translucent adhesive layers can be used for the embedding operation so that there is no need for application after embedding of the security element in the carrier substrate. In regard to optical veiling of the presence of window openings in the carrier substrate, integration of transparent colour layers in the security element in combination with an additional application of translucent colour layers after embedding of the security element or a use of translucent adhesive layers for embedding purposes can also be advantageous.

For case b) it is preferred if the at least one layer simulating the first watermark is respectively covered at least partially on the first side and a second side opposite the first side of the security document by at least one translucent layer, wherein the at least one translucent layer on the first side and the at least one translucent layer on the second side scatter incident light to differing degrees.

Finally it has proven desirable if in case b) the security element is arranged on the second side and the layer simulating the watermark is covered by at least one translucent colour layer arranged on the second side or the security element is embedded into the translucent carrier substrate in such a way that the security element is disposed in a plane parallel to the first side and the second side but at an unequal spacing relative to the first side and the second side, or the security element is embedded in the translucent carrier substrate and the layer simulating the watermark is covered by at least one translucent colour layer arranged on the first side and/or the second side, wherein the layer simulating the first watermark when viewed from the second side in the transillumination mode shows at least one second image which simulates a presence of at least one second watermark different from the first watermark in the carrier substrate.

In the case of a security document in accordance with case b), a viewer also sees as usual a first watermark when viewing the first side, in the transillumination mode. In the incident light mode, on the second side, the viewer does not see or only partially sees the at least one layer simulating the first watermark. In the transillumination mode however, a second watermark different from the first watermark presents itself to the viewer on the second side. That effect is achieved by the security document being of such a configuration that the light passing through is scattered to differing degrees between the layer simulating the first watermark and the first side and between the layer simulating the first watermark and the second side. That provides that for example filigree openings can be provided in the layer simulating the first watermark, viewed in the transillumination mode, from the second side, but not from the first side.

In case b) it has proven desirable if the carrier substrate is formed from at least two layer portions of differing materials. In addition embedding of the security element and the arrangement and configuration of translucent layers can be effected similarly to case a) already described hereinbefore.

Imitation of the security document according to the invention, in accordance with one of cases a) and/or b) is only possible with difficulty as it is necessary to implement exact provision of different layer thicknesses and/or openings or transparent regions at the at least one layer simulating the first watermark, in dependence on the material of the at least one layer simulating the first watermark, or the scattering characteristics of layers must be specifically adjusted in conformity with the configuration of the layer simulating the first watermark.

For case c) it has proven advantageous if the at least one layer simulating the first watermark has regions of a transmissivity dependent on the viewing angle.

It has further proven to be advantageous if in case c) the at least one first watermark in the transillumination mode shows a kinematic effect and/or a three-dimensional effect and/or a colour change effect upon tilting of the security document at least on one side of the security document.

In the case of a security document in accordance with case c), a viewer also perceives a first watermark as usual when viewing the first side in the transillumination mode. The viewer also sees the watermark on the second side. When the security document is tilted however, a kinematic effect and/or a three-dimensional effect and/or a colour change effect appears, at least on one side of the security element. The first watermark with kinematic effect appears to the viewer as if it were moving, for example as if an illustrated person were performing a movement. The first watermark with three-dimensional effect appears to the viewer as if a three-dimensional object were embedded in the carrier substrate. The first watermark with colour change effect presents the viewer with a different colour or colours at different viewing angles. Those effects which can be combined together are essentially achieved in that the security element has a local transmissivity which is dependent on the viewing angle and which is essentially governed by the configuration of the at least one layer simulating the first watermark, possibly also by virtue of the provision of diffractive structures and spacer layers in the security element.

In this case also embedding of the security element and the arrangement and configuration of translucent layers can be similar to case a) already described hereinbefore.

In particular a combination of cases a) to c) has proven desirable, insofar as the security document, or also the security element, has at least one first region which is designed in accordance with one of cases a) to c) and further has at least one second region which is designed in accordance with at least one case a) to c) which is different in relation to the first region. The effects which can be achieved can thus be combined in a particularly effective manner. In that respect the different effects can occur on a single security element or distributed over a plurality of security elements.

In that respect a plurality of security elements which are of a similar and/or different configuration can be used on one security document. Thus for example at least one first security element can be arranged on the second side and a second security element can be embedded in the carrier substrate. Furthermore, security elements can be arranged on both sides of the security document, which security elements simulate the presence of a watermark on the respectively opposite side when viewed in the transillumination mode. An at least partially overlapping arrangement of at least two security elements respectively simulating a watermark in the transillumination mode, viewed perpendicularly to the plane of the security document, is also possible.

If at least one translucent colour layer is used it is desirable if it does not differ in colour or differs in colour only imperceptibly from adjoining regions of the carrier substrate, which are possibly printed in colour. In that way the presence of the security element is optically concealed or rendered unrecognisable in those regions, for the viewer.

It is preferable if the at least one layer simulating the first watermark has transparent regions and/or openings whose dimensions, at least in one direction, are below the resolution limit of the human eye, that is to say less than about 0.3 mm. Particularly preferred are openings whose dimensions, at least in one direction, are in the region of 1 to 250 μm, in particular in the region of 2 to 100 μm, and in particular in the region of 5 to 80 μm. Such transparent regions or openings are invisible to the human eye in the incident light mode, but in the transillumination mode can be perceived without any problem by virtue of the enhanced transmission of light.

It has further proven desirable if the at least one layer simulating the first watermark has transparent regions and/or openings, wherein the mean surface density of the transparent regions or openings in the opaque layer is <10%. Such transparent regions or openings are also substantially invisible to the human eye in the incident light mode but can be perceived without problem in the transillumination mode by virtue of the enhanced transmission of light.

It is also advantageous if the at least one layer simulating the first watermark has regions of differing layer thickness. The regions of differing layer thicknesses can appear opaque throughout to the human eye in the incident light mode, but regions of smaller layer thickness, in the transillumination mode, can be distinguished without any problem from regions of greater layer thickness, by virtue of the enhanced transmission of light.

In transparent regions which are perceived as equivalent to a through opening in the at least one layer simulating the first watermark, the material used for forming the at least one layer simulating the first watermark can be present in such a small thickness that it has no substantial or perceptible influence on the transmission properties of the security document.

The structuring of the at least one layer simulating the first watermark, or the formation of openings or transparent regions, can be implemented in this respect by a process in accordance with DE 102004042136 A1. In that case the layer thickness of the layer is adjusted by the material for forming the layer being uniformly applied to a surface provided with diffractive surface structures, wherein a locally different effective layer thickness is set in dependence on the depth-to-width ratio of the surface structures.

The at least one layer simulating the first watermark can at least region-wise be of a continuously changing layer thickness, in the regions appearing opaque in the incident light mode. Alternatively or in combination therewith the at least one layer simulating the first watermark can at least region-wise be of a stepwise changing layer thickness, in the regions appearing opaque in the incident light mode. The provision of the differing layer thickness produces an optical density or transmissivity which differs when viewed in the transillumination mode and can also be implemented in accordance with a process as disclosed in DE 102004042136 A1.

It has further proven to be advantageous if the at least one layer simulating the first watermark has openings in such a way that that layer is structured in the form of a fine dot or line raster with a raster width of less than 300 μm. It is particularly preferred in that respect if the layer is structured in the form of an aperiodic dot or line raster.

In that respect the term "dot" is used not only to denote round image dots but also other geometrical shapes such as triangular, rectangular, elliptical and so forth image dots. Image dots in the form of symbols, graphic representations, alphanumeric characters or character sequences are also possible. In that case the dots or lines are either arranged in a regular raster spacing or a locally or constantly changing raster spacing. Alternatively or in combination therewith the surface extent of the dots or lines can vary.

It has proven desirable if the regions forming the dot or line raster of the at least one layer simulating the first watermark are provided in substructured fashion in at least region-wise manner. In that respect a substructuring denotes for example a phase displacement of a subset of image dots or lines with respect to the rest of the raster. Further possible options in relation to substructuring involve a local change in a curvature of lines, a local change in the orientation of the image dots or lines, a local change in the dot or line spacings, a local change in shape of image dots or lines, a configuration in the form of different characters or pixels and so forth. Thus for example a single line can be substructured by the line being composed of a sequence of letters which at least portion-wise has a given information content which can be read out. Such substructurings can only be read out with ancillary means, for example by means of a magnifying glass or by means of superimpositioning with a further dot or line raster in the manner of a verification plate.

It is particularly preferred if the security element has at least two layers which are arranged in mutually overlapping relationship in at least region-wise manner and which simulate the first watermark. In that case arranged between the at least two layers simulating the at least one first watermark there is preferably at least one transparent spacer layer.

In that arrangement the first and second layers preferably have a multiplicity of subregions which differ in their transmission and reflection properties. Those different subregions are preferably arranged in the respective layer in accordance with a regular periodic raster. In that case the raster spacings are preferably below the resolution capability of the human eye. Depending on the respective viewing angle in that case different subregions of the first and second layers are in overlapping relationship in the beam path of the transmitted or reflected light so that, depending on the respective viewing angle, a different optical impression is given to the viewer in the incident light mode and in the transillumination mode.

Furthermore it is also possible here for the first and second layers to also have diffractive structures in subregions, the diffractive structures acting in a transmission or reflection mode. In that way it is further possible to produce an optically variable impression which is dependent on the viewing angle.

When the security document is tilted, it is preferably possible to recognise different transmissivity and/or colouration dependent on the tilt angle, in the overlap region of the at least two layers simulating the at least one first watermark, in the transillumination mode. That is a preferred embodiment in particular for case c).

If there are provided three or more layers which are spaced by spacer layers and which simulate the at least one watermark, the angle resolution of the effect which is dependent on the viewing angle can be further refined by a differing thickness in respect of the transparent spacer layer.

It is advantageous if provided on the security document are at least two layers which simulate the at least one first watermark and which are respectively structured in the form of a microscopically fine dot or line raster and which in mutually superposed relationship present an in particular periodic moiré pattern.

It has proven desirable if the security element has an optically variable effect which is visible when viewing in the incident light mode.

In that respect in particular the security element has an optically variable material, in particular an optically variable pigment, a liquid crystal material, a luminescent material or a thermochromic material, and/or a diffractive or refractive structure, in particular a hologram, a kinegram®, a stochastic matt structure, an asymmetrical matt structure, a macrostructure, a light-absorbent structure or a microlens structure.

It has proven advantageous if the security element has at least one transparent layer which adjoins the at least one layer simulating the first watermark and in which in particular a diffractive relief structure is shaped. Preferably the transparent layer is in the form of a lacquer layer, in particular a thermoplastic or UV-hardened lacquer layer. In that case the transparent layer can also be provided without a diffractive structure and can serve as a protective layer for the layer simulating the at least one first watermark, in order at least region-wise to cover over a visible layer which is arranged on the security document and which simulates the at least one first watermark, and to minimise mechanical stressing of that layer. In addition the transparent layer can serve as a spacer layer between the layers simulating the at least one first watermark or can impart a coloured appearance to that layer or the watermark in the transillumination mode, if it is coloured.

If the security element has at least two layers simulating the at least one first watermark, a translucent colour layer and/or a transparent layer, possibly including diffractive structures, is preferably arranged between them.

A translucent colour layer is preferably formed by a pigmented colour lacquer layer. In that respect it is possible to use both pastel colours and also pure colours. In particular it has proven desirable if colour layers are formed by coloured photoresist layers which are produced region-wise in register relationship with the layer simulating the at least one first watermark. In that respect the layer simulating the at least one first watermark can serve as an exposure mask for structuring the photoresist layers in register relationship.

In particular the transparent layer has a multiplicity of microlenses wherein a layer thickness of the at least one transparent layer at least approximately corresponds to the focal length of the microlenses.

It is provided in that respect that the security element has one or more transparent first layers and a second layer which has a multiplicity of micropatterns comprising one or more opaque first subregions and one or more transparent second subregions, one of the first layers on its surface remote from the second layer has a surface profile forming a multiplicity of first microlenses, and the thickness of that first layer or that first layer and one or more further first layers arranged between that first layer and the second layer approximately corresponds to the focal length of the first microlenses. The security element therefore has first subregions in which at least the second layer is opaque; and it has second subregions in which all layers of the security element are transparent. In the region of the second subregions the security element is transparent throughout, that is to say the layers of the security element are transparent in the region of the second subregions. Such a security effect produces very different optical effects when viewed from the front side and from the rear side, and such effects form a security feature which is difficult to imitate. The microlenses shaped in one of the first layers form an optical imaging system suitable for enlarging the micropatterns. A respective image dot of the micropattern per microlens is selected, by the microlenses. That effected in a very strong-light fashion by the microlenses, in principle however a shadow mask would also function. The micropattern comprises first subregions which appear opaque, that is to say not transmitting light, for the human viewer or the human eye (due to absorption or reflection of the incident light), and second subregions which appear translucent to the human viewer or the human eye. The overall impression produced in that way presents transparent image regions which change in position in dependence on the viewing direction so that it can appear that a transparent image region floats in front of an opaque background. Images can apparently appear behind the surface of the security element or in front of or in the surface thereof, depending on whether the raster width of the microlenses is greater or smaller than the raster width of the microimages. If the two raster widths are exactly the same but are somewhat turned relative to each other, the interesting effect is then to be observed that images appear to move from left to right when the security element is moved somewhat backwards and forwards and images appear to move forwards and backwards when the security element is moved towards the left and right. It is further possible for images to be shown in laterally inverted or rotated relationship, that is to say the images can be enlarged versions of the micropatterns (magnification >1) or the images can be laterally inverted or turned versions of the micropatterns (magnification <−1). When viewed from the rear side in contrast the security element appears as an opaque surface which can show for example information in the form of a half-tone or grey scale image. That apparent contradiction between the two optical impressions is shown both in the incident light mode and also in the transillumination mode and is highly striking and easy to remember. Inevitable production tolerances in respect of the radius of the microlenses, the refractive index and the thickness of the microlens layer do not adversely affect the functional capability of the security element. As experiments have shown the thickness of the microlens layer can differ from the reference target value by between 10% and 20% of the focal length.

It is preferred if the at least one layer simulating the at least one first watermark is provided by at least one metal layer and/or at least one pigmented layer, in particular a highly pigmented colour lacquer layer. In that respect, the layer simulating the at least one first watermark is preferably opaque, at least when viewed in the incident light mode, for the human eye under normal illumination conditions, that is to say in daylight and artificial light. When viewed in the transillumination mode however that layer can be at least region-wise translucent.

In particular aluminium, silver, gold, chromium, copper, titanium and so forth and alloys thereof are suitable for forming a metal layer which appears opaque to the human eye in the incident light mode. In the production of regions which are transparent or transmissive visibly in the transillumination mode, it is important to know and appropriately select the individual influencing parameters involved in the formation of the metal layer, in respect of their dependencies. Especially in the case of the metal layers it is necessary to take account of the existing absorption, due to which the total of transmission and reflection is less than 100%. A viewer already perceives a region of a metal layer in the incident light mode as being fully reflective if 85% of the incident light is reflected, and he already perceives a region as being transparent if less than 20% of the incident light is reflected, that is to say more than 80% is allowed to pass through. Those values can vary in dependence on the background, illumination and so forth. In that respect an important part is also played by the kind of metal, in regard to the absorption of light in the metal layer. For example under some circumstances chromium and copper reflect much less than gold and silver. That can mean that only 50% of the incident light is reflected, with the degree of transmission being less than 1%.

The degree of transmission possibly also decreases if the angle of incidence of the light differs from the normal angle of incidence, that is to say the degree of transmission decreases if the light is not incident perpendicularly. That means that a metal layer can be transmissive for example in the region of a surface relief structure, only in a limited cone of light incidence. It can therefore be provided that a metal layer appears opaque in the incident light mode only when viewed obliquely.

It is further preferred if the at least one layer simulating the first watermark is formed from a combination of at least one metal layer and at least one pigmented layer.

The pigmented layer preferably also involves a layer which appears opaque to the human eye under normal illumination conditions, at least when viewed in the incident light mode. In the transillumination mode however, just as in the case of the metal layer, there can be translucent regions. If the layer simulating the at least one first watermark is at least partially visible on the security document, then with a combination of metal layer and pigmented layer, coloured patterns can be produced in combination to afford metal layers, visible in the incident light mode, and the layer simulating the at least one first watermark can thus be of a particularly forgery-resistant nature.

It has proven desirable if the carrier substrate is provided with a translucent security imprint thereon. Security imprints can usually only be imitated with difficulty, by virtue of their configuration or the materials used. Thus, banknotes usually employ a security imprint consisting of filigree lines or guilloche patterns, while in addition it is possible to use optically variable materials.

It is particularly preferred if the layer simulating the at least one first watermark when viewed in the incident light mode and/or in the transillumination mode presents a half-tone image.

It is particularly advantageous if the security imprint includes coloured material and/or magnetic material and/or electrically conducting material and/or optically variable material, in particular luminescent material, thermochromic material, interference pigments or liquid crystal material. Thus for example luminescent material of a safety imprint can be superposed with the at least one layer simulating the at least one first watermark, wherein in the transillumination mode intensive illumination of the translucent regions or openings can be observed in the at least one layer simulating the at least one first watermark.

It is preferred if the security element is formed by a lamination film or a transfer layer portion of a transfer film. A lamination film has a self-supporting, translucent or transparent carrier film, on which are formed the at least one layer simulating the at least one first watermark and, depending on the respective requirements involved, further layers such as transparent layers, optically variable layers, translucent layers, adhesive layers and so forth.

A transfer film usually has a self-supporting carrier film, on which there is disposed a transfer layer portion which is made up from the at least one layer simulating the at least one first watermark and, depending on the respective requirement involved, further layers such as protective layers, transparent layers, optically variable layers, translucent layers, adhesive layers and so forth. The individual layers of the transfer layer portion are usually so thin that, like also the transfer layer portion, they are not self-supporting.

Thus a lamination film is usually of a thickness which is at least 50% greater in comparison with a transfer layer portion and is accordingly suitable for use in a continuous extending window in the carrier substrate. The carrier film of the transfer film is removed after the transfer layer portion is fixed on the carrier substrate of the security document. That requires a good release characteristic on the part of the carrier film from the transfer layer portion, and that can possibly be adjusted in a defined manner by an arrangement of wax-like or silicone-like release layers between the carrier film and the transfer layer portion.

The security document according to the invention can be a banknote, a bank card, an ID card, a pass, a passport, a value-bearing paper, a deed or many more. Banknotes can involve conventional banknotes with a substrate of security paper or banknotes with a substrate in the form of a multi-layer laminate of plastic material.

In that case the security element is embedded in or applied to the corresponding carrier substrate of the security document. The security element is preferably applied by stamping, adhesive or lamination. The security element can be embedded directly in a carrier substrate. When the security element is embedded for example in paper that can be effected by the security element already being integrated in the paper production process or being introduced between individual paper layers which are to be joined together in flat relationship, in particular being glued therebetween or being introduced between paper layers when they are still moist. In the case of multi-layer substrates, the security element can be introduced, glued in place or laminated into position between the layer portions of the substrate. In the case of the cards with a main card body of plastic material or a plurality of card layer portions of different materials, a security element can be laminated in place between individual card layer portions, stamped onto a card layer portion and can then have material injected thereover in an injection moulding process, or directly integrated into a card layer portion which is formed by means of injection moulding and which in this case can also correspond to the complete main card body. Embedding can also be optically simulated if the security element has applied thereto by printing, stamping and so forth, a transparent layer which is adapted to the optical appearance of the carrier substrate.

BRIEF DESCRIPTION OF THE DRAWINGS

FIGS. 1*a* to 8*b* are intended to illustrate merely by way of example the security document according to the invention and the formation thereof. In the drawings:

FIG. 1*a* shows a security document in the form of a banknote with a security element simulating the presence of a watermark, FIG. 8*b* shows a diagram relating to the dependency of transmission/reflection or optical density of a silver layer on its layer thickness under normal illumination.

DETAILED DESCRIPTION OF THE INVENTION

Figure 1A:
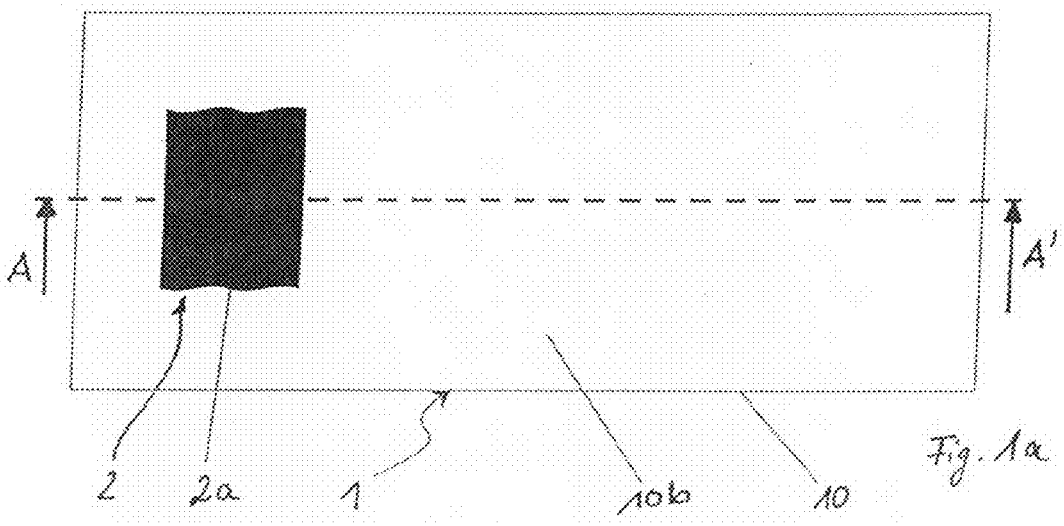

FIG. 1*a* shows a plan view of a security document 1 in the form of a banknote with a security element 2 in the incident light mode. The banknote has a translucent carrier substrate 10 of paper. The security element 2 is glued on the second side 10*b* of the security document 1, in the form of a film element including a layer 2*a* of aluminium, simulating the at least one first watermark. For the sake of clarity, the Figure does not show further components of the banknote such as security imprints and so forth.

Figure 1B:
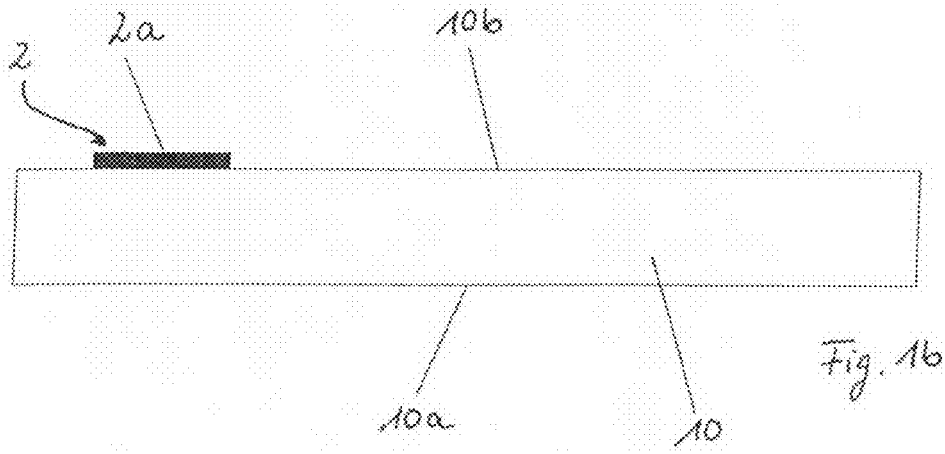
FIG. 1*b* shows the security document of FIG. 1*a* in section on A-A'.

FIG. 1*b* shows the security document 1 of FIG. 1*a* in section on A-A'.

Figure 1C:
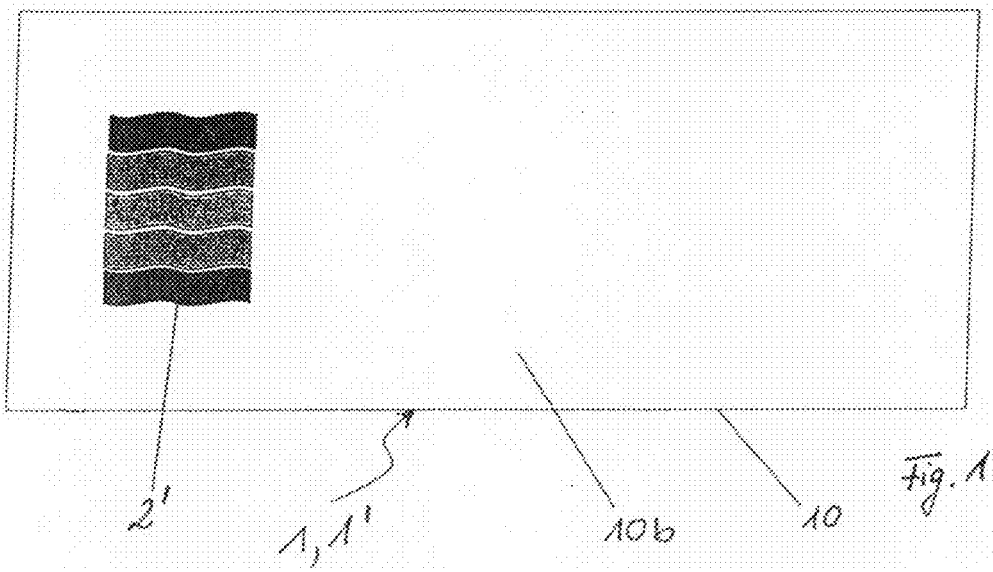
FIG. 1*c* shows the security document of FIG. 1*a* viewed from the second side in the transillumination mode.

FIG. 1*c* shows the security document 1 of FIG. 1*a* viewed from the second side 10*b* in the transillumination mode. In this case a watermark 2' simulated by the security element 2 presents itself to the viewer in the region of the security element 2. The watermark 2' is composed of five strips which are curved in a wave configuration and which have different transmission properties. In that case the two downwardly and upwardly arranged strips have a lower level of transmission than the strips enclosed thereby and thus have a darker action in the transillumination mode. Although the security element 2 shows itself as a closed reflective opaque surface of aluminium in the incident light mode by virtue of the layer 2*a* simulating the at least one first watermark, in the transillumination mode that surface is translucent to different degrees and visibly subdivided into individual regions or strips involving different grey scales. That is achieved in that the layer 2*a* simulating the at least one first watermark is formed with a differing layer thickness. The layer thickness of the layer 2*a* ranges in the region of 10 nm to 100 nm, in particular in the region of 10 to 50 nm. Adjacent regions of differing layer thickness differ by 2 nm to 50 nm, in particular 2 to 20 nm. It will be noted that this crucially depends on the material from which the layer 2*a* simulating the first watermark is formed. Here the layer 2*a* simulating the first watermark is formed from aluminium and the transmission or optical density OD thereof is specifically shown in FIG. 8 under normal illumination as a function of the layer thickness (in nm) of an aluminium layer.

Thus the layer 2*a* simulating the at least one first watermark is of greater layer thickness in the region of the upwardly and downwardly arranged strips shown in black, than in the region of the two strips arranged therebetween and shown as dark grey. In the region of the light grey strip in the centre, the layer 2*a* simulating the at least one first watermark is in turn of a smaller layer thickness than in the region of the dark grey strips. There is a respective light separating line between the individual strips in the transillumination mode. In the region of the separating lines the layer 2*a* simulating the at least one first watermark is of an even smaller layer thickness than in the region of the central strip. The layer thicknesses of the layer 2*a* simulating the at least one first watermark are respectively to be so selected that different transmission or translucence values are achieved in the transillumination mode. As the viewer perceives an opaque aluminium surface in the incident light mode, he is correspondingly more surprised when the watermark 2' which differs in shape and configuration is unexpectedly visible in the transillumination mode.

Figure 1D:
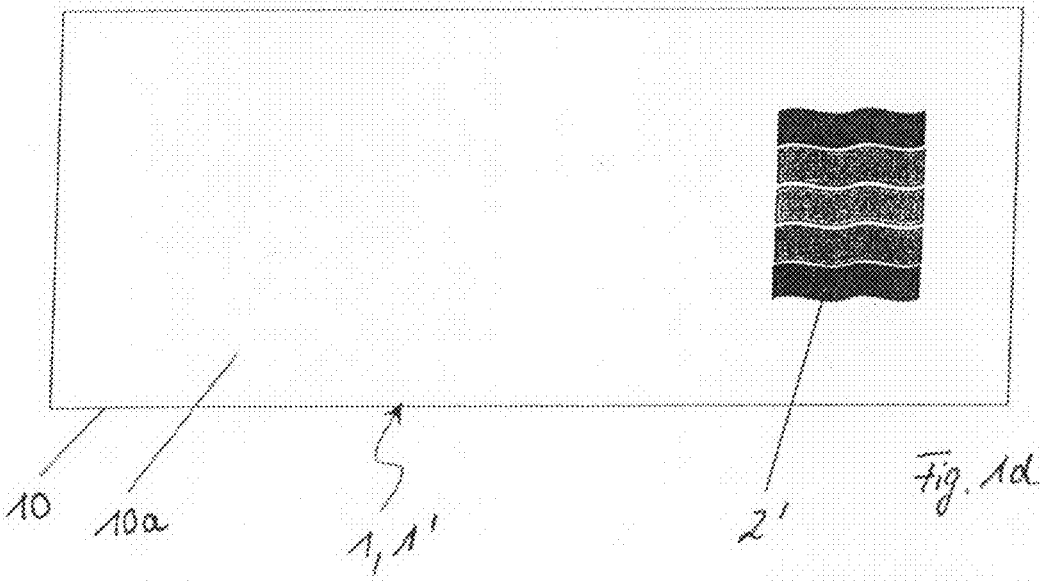
FIG. 1*d* shows the security document of FIG. 1*a* viewed from the first side in the transillumination mode.

FIG. 1*d* now shows the security document 1 of FIGS. 1*a* to 1*c* viewed from the first side 10*a* in the transillumination mode. In this case, the watermark 2' is shown in identical fashion to the view from the second side 10*b*, but only in laterally inverted form.

Figure 2A:
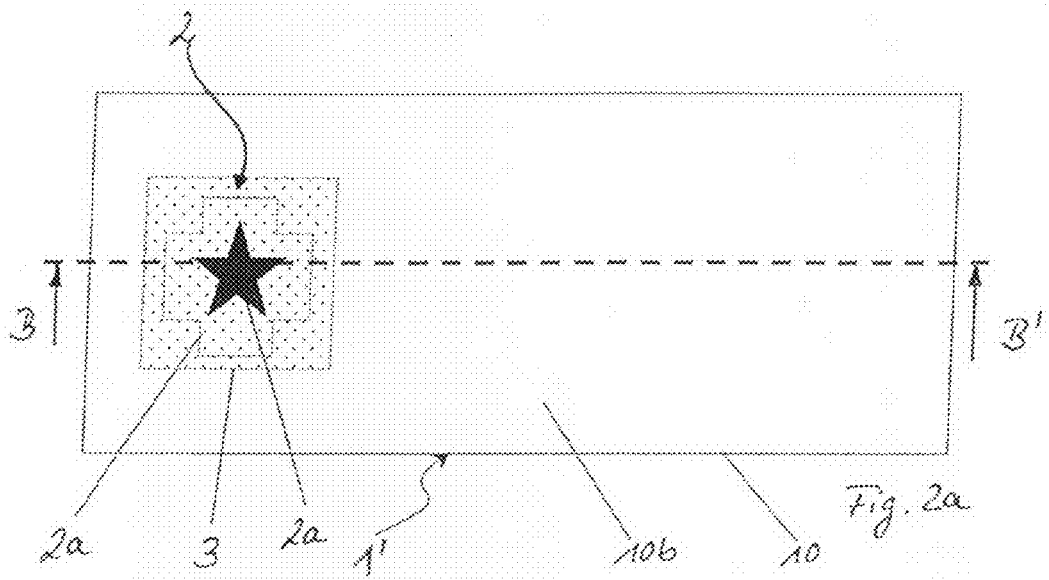
FIG. 2*a* shows a further security document in the form of a banknote with a security element simulating the presence of a watermark.

FIG. 2*a* shows a plan view of a security document 1' in the form of a banknote with a security element 2 in the incident light mode. The banknote has a translucent carrier substrate 10 of paper. Stamped onto the second side 10*b* of the security document 1' is the security element 2 in the form of a film element which includes a layer 2*a* of aluminium simulating the at least one first watermark. Between the layer 2*a* simulating the at least one first watermark and the viewer is a translucent layer 3 which is applied by printing in pattern form and which has a star-shaped opening which is formed from a pigmented lacquer layer of a similar colour to the adjoining carrier substrate 10 and which veils the actual dimensions of the layer 2*a* simulating the at least one first watermark (here the shape of a cross, as shown in broken line). The layer 2*a* simulating the first watermark is thus directly visible only in the region of the star-shaped opening in the translucent layer 3 while its other regions are invisible in the incident light mode. For the sake of enhanced clarity here further components of the banknotes such as security imprints and so forth are not shown.

Figure 2B:
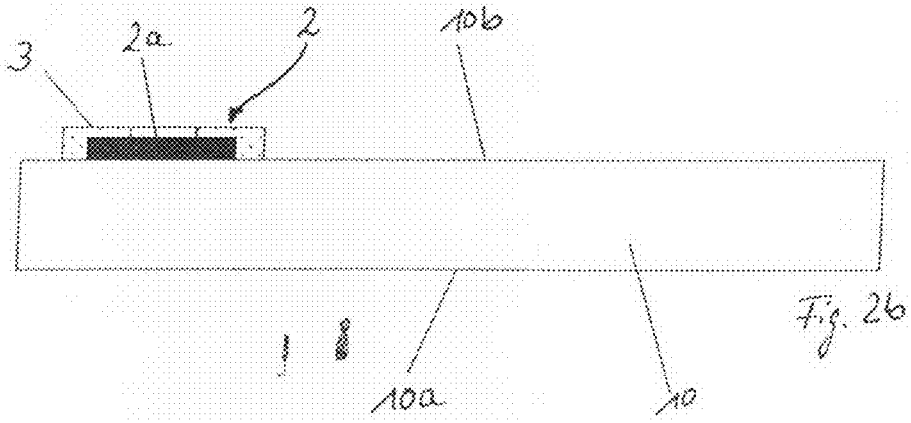
FIG. 2*b* shows the security document of FIG. 2*a* in section on B-B'.

FIG. 2*b* shows the security document 1' of FIG. 2*a* in section on B-B'. It will be clearly seen that the star-shaped opening in the translucent layer 3 leaves uncovered only a part of the layer 2*a* simulating the first watermark.

Viewed in the transillumination mode the security document 1' of FIG. 2*a* can show a similar watermark 2' (see FIG. 1*c*) to the security document 1 of FIG. 1*a*, but with a cross-shaped contour. In that case the watermark 2' simulated by the security element 2 is shown to the viewer in the region of the security element 2. Although, in the incident light mode, the security element 2, of the layer 2*a* simulating the at least one first watermark, only shows a closed star-shaped reflecting opaque surface of aluminium, when viewed in the transillumination mode the layer 2*a* is sub-divided into individual regions or strips involving different levels of light transmissivity or grey scales. That is achieved in that the layer 2*a* which is opaque in the incident light mode is formed region-wise with a differing layer thickness and/or has a multiplicity of openings, the spacing of which at least in one direction is below 0.3 mm. Thus for example the holes are each of a diameter of about 2 to 100 μm or involve a surface area occupied by the respective hole of about 3 to $75*10^3$ $um^2$ and are spaced from each other in a raster grid involving a raster width of 20 to 300 μm in the X-direction and 20 to 300 μm in the Y-direction. The area component of the holes is between about 0.003 and 10%. As in the incident light mode the viewer perceives a star-shaped opaque aluminium surface, he is correspondingly more surprised when, in the transillumination mode, he unexpectedly sees a watermark of cross-shaped contour, which differs in shape and configuration.

The security document 1' in FIG. 2*a*, viewed from the first side 10*a* in the transillumination mode, presents an appearance similar to that shown in FIG. 1*d*, but with a cross-shaped outline. In this case the simulated watermark is shown identically to the view from the second side 10*b*, only in laterally inverted form.

Figure 3A:
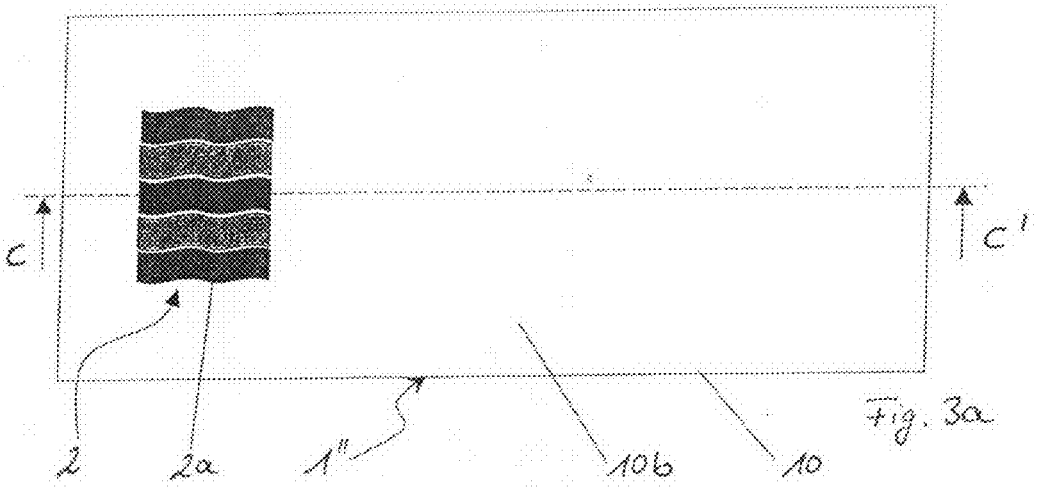
FIG. 3*a* shows a further security document in the form of a banknote with a security element simulating the presence of a watermark.

FIG. 3*a* shows a further security document 1" in the form of a banknote with a security element 2 applied thereto by stamping. The layer 2*a* simulating the at least one first watermark is formed by individual image dots of aluminium (not shown separately) which are arranged in a regular raster grid with a raster width of 5 to 300 μm, in particular 10 to 100 μm, and which appear opaque in the incident light mode, wherein the carrier substrate 10 is visible between the image dots, at least when viewed under a microscope. The image dots cover 80 to 100% of the surface area. A further reduction in the area component of the image dots can be achieved if reflection of the layer 2*a* simulating the watermark is adapted to the reflection of the background or carrier substrate 10, for example by means of a scattering microstructure. The layer 2*a* simulating the at least one first watermark shows a half-tone or grey scale image comprising five curved strips in two different grey tones, in the incident light mode.

Figure 3B:
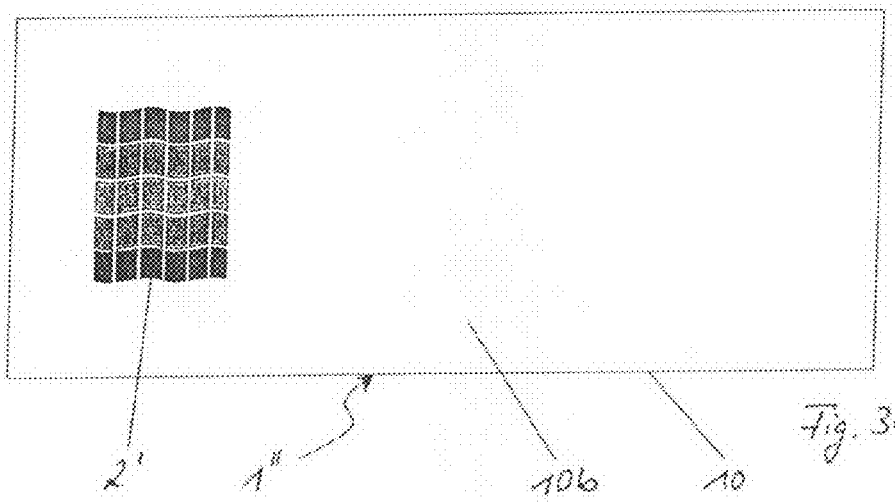
FIG. 3*b* shows the security document of FIG. 3*a* viewed from the second side in the transillumination mode.

FIG. 3*b* shows the security document 1" of FIG. 3*a*, viewed from the second side 10*b*, in the transillumination mode. By virtue of different layer thicknesses in respect of the individual image dots of the layer 2*a* simulating the at least one first watermark, a first watermark 2' with regions of differing translucency is shown in the transillumination mode. Thus the central curved strip in the transillumination mode is more translucent than the strips above and below and it is also possible to see five perpendicular filigree lines of high translucency.

Figure 3C:
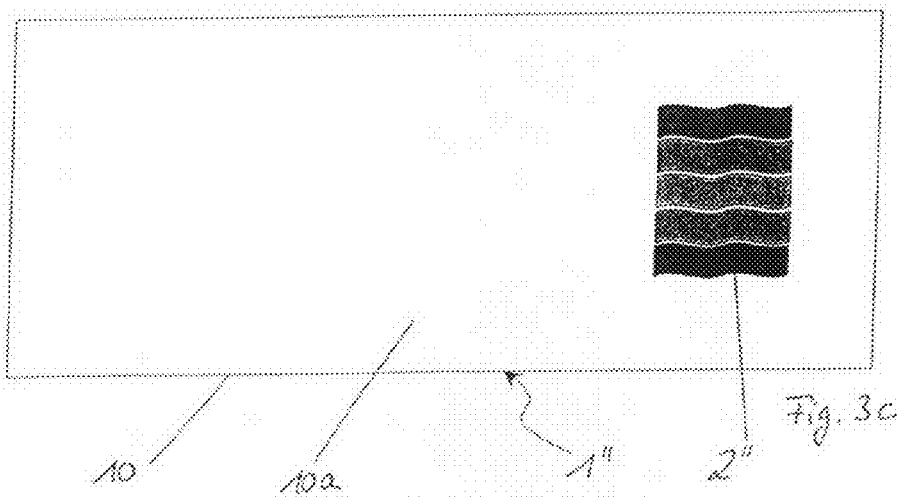
FIG. 3*c* shows the security document of FIG. 3*a* viewed from the first side in the transillumination mode.

FIG. 3*c* shows the security document 1" of FIG. 3*a*, viewed from the first side 10*a* in the transillumination mode. In this case the viewer sees a similar second watermark 2" which is laterally inverted relative to the first watermark 2' but which does not show the five perpendicular filigree lines of high translucency. That is achieved by the carrier substrate 10 scattering the light passing therethrough, in the region of the particularly transmissive filigree lines of the security element 2 on the first side 10*a*, so greatly that they visually no longer appear in the transillumination mode.

Figure 3D:
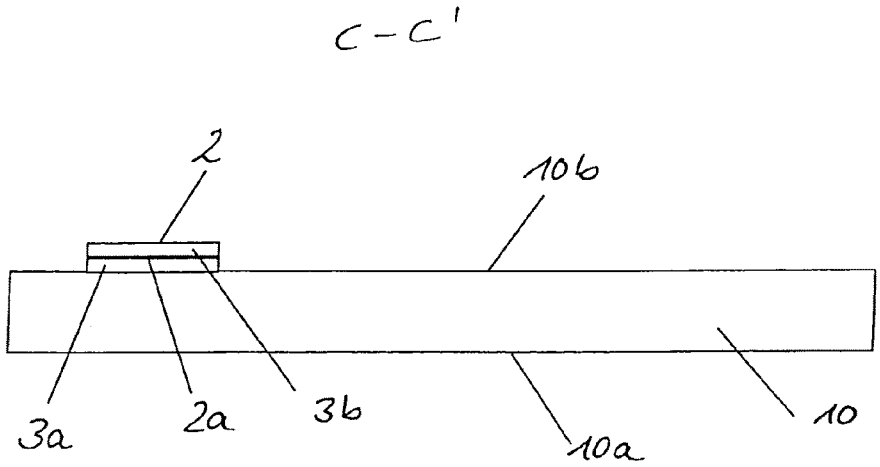
FIG. 3*d* shows the security document of FIG. 3*a* in section on C-C'.

FIG. 3*d* shows the section C-C' through the security document 1" in FIG. 3*a*. The security element 2 has a transparent hot melt adhesive layer 3*a*, the layer 2*a* simulating the at least one first watermark and a transparent lacquer layer 3*b* and is glued onto the carrier substrate 10. In this case the security element 2 is formed by the transfer layer portion of a transfer film and is formed in a transfer process on the carrier substrate 10.

Figure 3E:
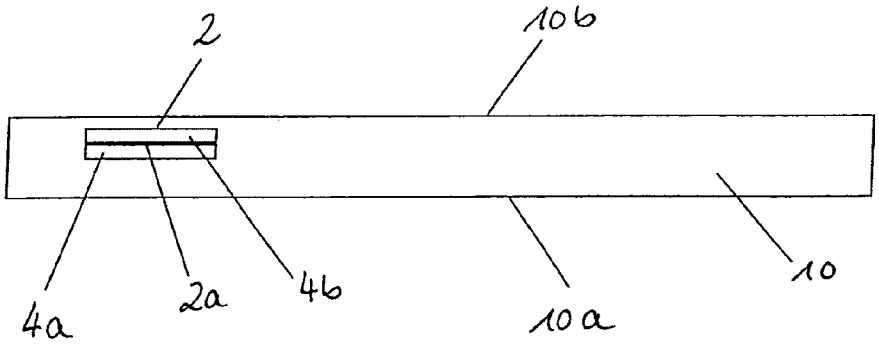
FIG. 3*e* shows a section of a security document with a security element asymmetrically embedded in the carrier substrate.

FIG. 3*e* shows a view in section of a security document 1" with a security element 2 which is asymmetrically embedded in the carrier substrate 10 of paper and which is designed in principle like the security element 2 shown in FIGS. 3*a* to 3*d* and which gives a similar impression in the transillumination mode. In the incident light mode the security element 2 is essentially to be seen from neither side 10*a*, 10*b* of the security document 1". The security element 2 is in the form of a lamination film and has a transparent lacquer layer 4*a*, the layer 2*a* simulating the at least one first watermark and a transparent lacquer layer 4*b*. In that case, disposed between the security element 2 and the first side 10*a* is a paper layer portion which scatters the transillumination light more' greatly than between the security element 2 and the second side 10*b*. The paper layer portion between the security element 2 and the first side 10*a* is thus for example 10 to 95% thicker than the paper layer portion between the security element 2 and the side 10*b*, with a total layer thickness for the carrier substrate 10 of 50 μm to 2 mm, in particular 50 μm to 1 mm. Here the operation of embedding the security element 2 in the carrier substrate 10 is already effected during manufacture of the paper.

Accordingly, in the transillumination mode, by virtue of the increased thickness of the paper layer portion or the number of paper layer portions being increased on one side, that arrangement provides a longer distance to be covered by the light and involves greater scattering of the light so that less light reaches the security element 2 from one side. When the security element 2 is viewed from the first side 10*a*, a similar watermark is to be observed, as in FIG. 3*c*. In comparison therewith, when viewing it from the second side 10*b*, a similar watermark is to be observed as in FIG. 3*b*. In the transillumination mode the filigree lines are visible only from the second side 10*b* but not from the first side 10*a*.

Figure 4A:
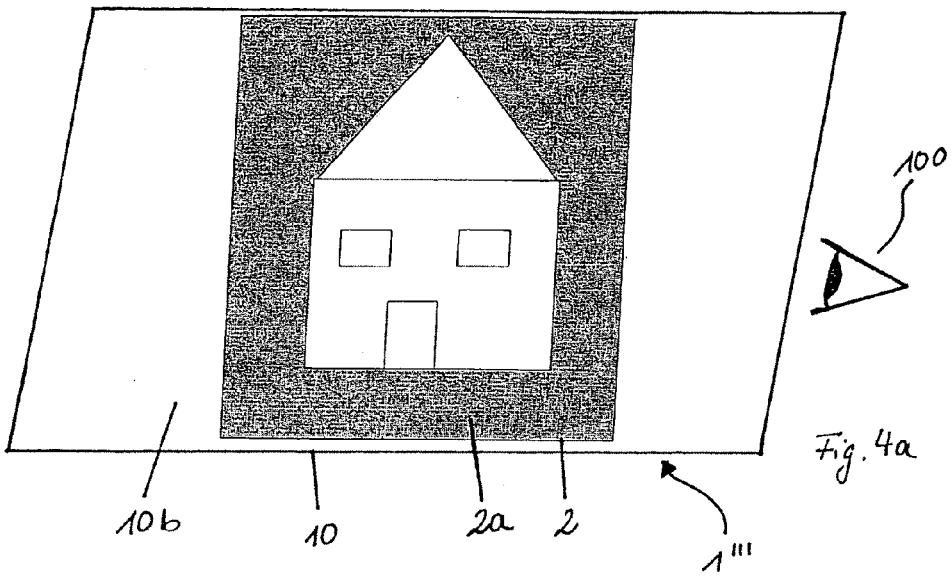
FIG. 4*a* shows a further security document in the form of a deed with a security element which in the transillumination mode simulates the presence of a watermark, wherein the security document is viewed here in the incident light mode.

FIG. 4*a* shows a further security document 1''' in the form of a deed with a security element 2 which in the incident light mode has an optically variable effect dependent on the viewing angle. Thus the viewer 100 of the security document 1''', from a first viewing direction, sees a security element 2 with a layer 2*a* which simulates the at least one first watermark and which appears opaque in the incident light mode, a house being seen as the first representation. The first representation is produced by diffractive first relief structures introduced into the layer 2*a*.

Figure 4B:
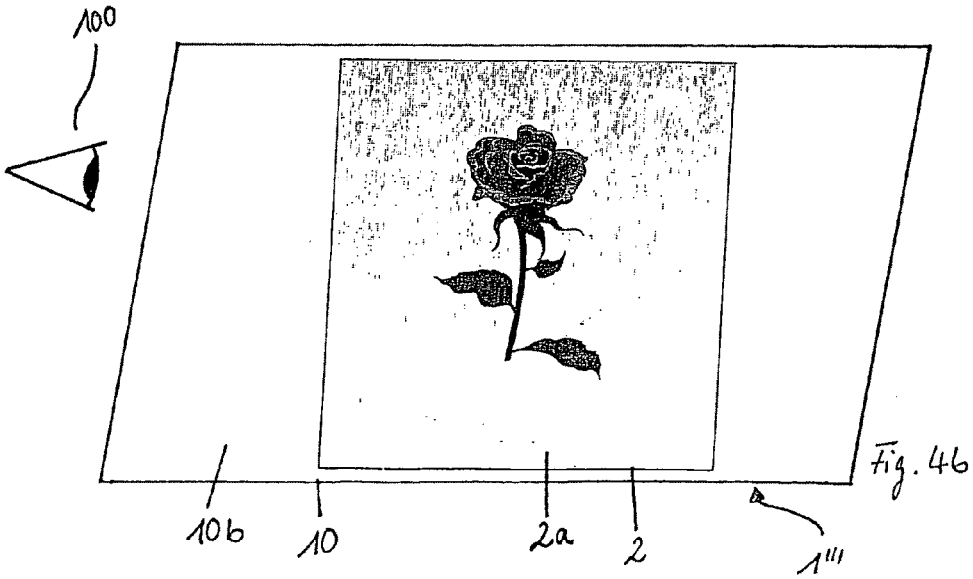
FIG. 4*b* shows the security document of FIG. 4*a* again in the incident light mode, but at a different viewing angle.

From a second viewing direction the viewer 100, as shown in FIG. 4*b*, also sees the security element 2 with a layer 2*a* which simulates the at least one first watermark and which appears opaque in the incident light mode. It will be noted however that, from that viewing direction, it is not the first representation that is to be seen, but a second representation in the form of a rose, by virtue of the second relief structures introduced into the layer 2*a*. In this case the first and second relief structures are formed for example by diffraction gratings with mutually different azimuth angles or by different asymmetric relief structures, for example blaze gratings involving a different flank angle.

Figure 4C:
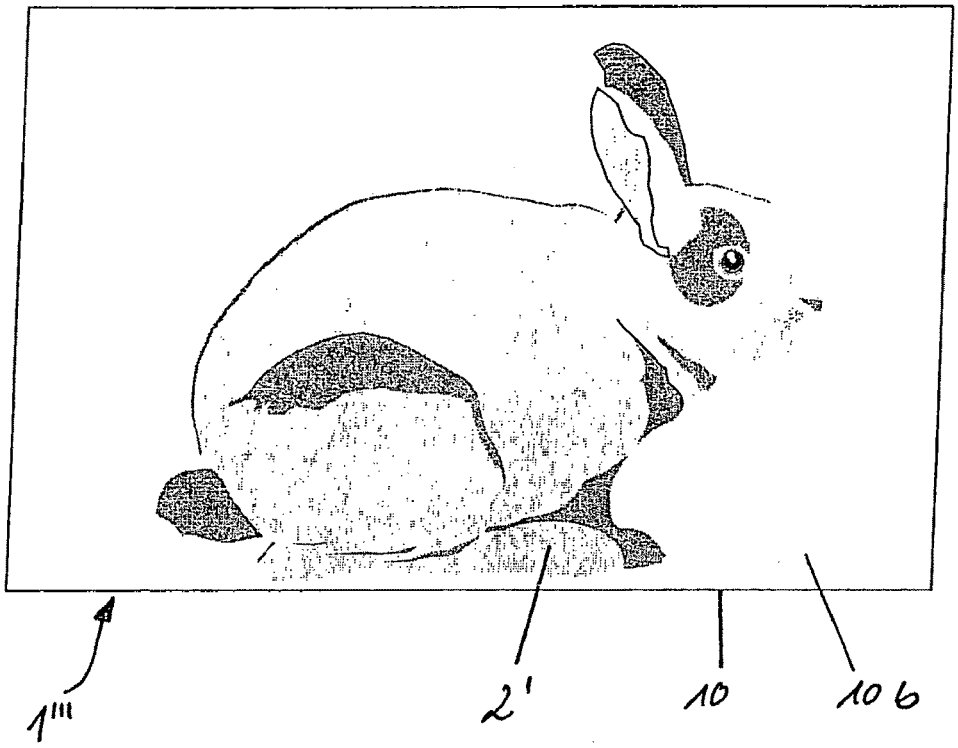
FIG. 4*c* shows the security document of FIGS. 4*a* and 4*b* in the transillumination mode.

FIG. 4*c* now shows the security document 1''' of FIGS. 4*a* and 4*b* on a somewhat enlarged scale in the transillumination mode. Neither the first nor the second representation is to be seen, but a third representation in the form of a hare with coloured background, as the watermark 2', which moreover is also shown from the other side 10*a*.

The security element 2 is adapted to implement the security document 1''' with a layer 2*a* of aluminium which simulates the at least one first watermark, and including diffractive structures arranged in a fine raster grid, the raster width of which in at least one direction is less than about 0.3 mm. A first group of raster surfaces contains the diffractive first structures which in a viewing direction serve to produce the first representation. A second group of raster surfaces includes for that purpose different diffractive second structures which in a second viewing direction serve to produce the second representation. A third group of raster surfaces includes openings which when viewed in the transillumination mode increase the transmissivity in region-wise manner to produce the third representation. The layer 2*a* which is opaque in the incident light mode here has openings which are invisible to the human eye in the incident light mode but which can be recognised in the transillumination mode. In that respect the relative size and local frequency of the openings is varied to produce different half-tones or grey scales in the transillumination mode. In that respect translucent colour layers and/or translucent diffractive structures with a transparent reflection layer as a background can be arranged in the region of the openings in order to produce colour effects and/or optically variable effects in the transillumination mode. So that the openings do not have any interfering influence on the first and second representations which are visible in the incident light mode, the raster surfaces having the openings are arranged in alternate relationship beside the diffractive raster surfaces. In that case the regions of the layer 2*a* simulating the at least one first watermark, which regions are to be associated with the third representation, appear metallically reflective in the incident light mode. Alternatively a third structure in the form of a matt structure can be present in the region of the raster surface provided with the holes, which has a similar scattering capability to the carrier substrate 10 so that the regions of the layer 2*a* simulating the at least one first watermark, which regions are to be associated with the third representation, are not conspicuous in the incident light mode. Furthermore there can also be a light-absorbing diffractive fourth structure in the regions of the layer 2*a* simulating the at least one first watermark, which regions are to be associated with the third representation, so that it appears dark in the incident light mode. In order in addition to have a coloured background for the third representation, at least one translucent or transparent coloured layer is preferably arranged in register relationship with the openings, that coloured layer being concealed in the incident light mode behind the layer 2*a* simulating the at least one first watermark but being recognisable in the transillumination mode and imparting colour or at least coloured regions to the third representation, in which respect there can be one or more colours.

In addition it is also possible for a fourth group of raster surfaces to be occupied with the third structures and a fifth group of raster surfaces to be occupied with the fourth structures, whereby besides the first, second and third representation, there can also be a fourth and a fifth representation afforded by the security element 2, which in the incident light mode are formed by the third and fourth, or the third and fifth, group of raster surfaces. Furthermore a filigree kinegram® can be arranged in superposed relationship with the effects, which has scarcely any interference action on the watermark effect and which serves to deflect the eye from the raster grid and thus conceal it.

In this case the raster surfaces of the first to third groups of raster surfaces are preferably arranged alternately in accordance with a regular raster grid, for example in the sequence of raster surface of the first group, raster surface of the second group, raster surface of the third group, raster surface of the first group and so forth. In that respect the period in which the sequence is repeated is selected to be less than 0.3 mm.

Figure 5A:
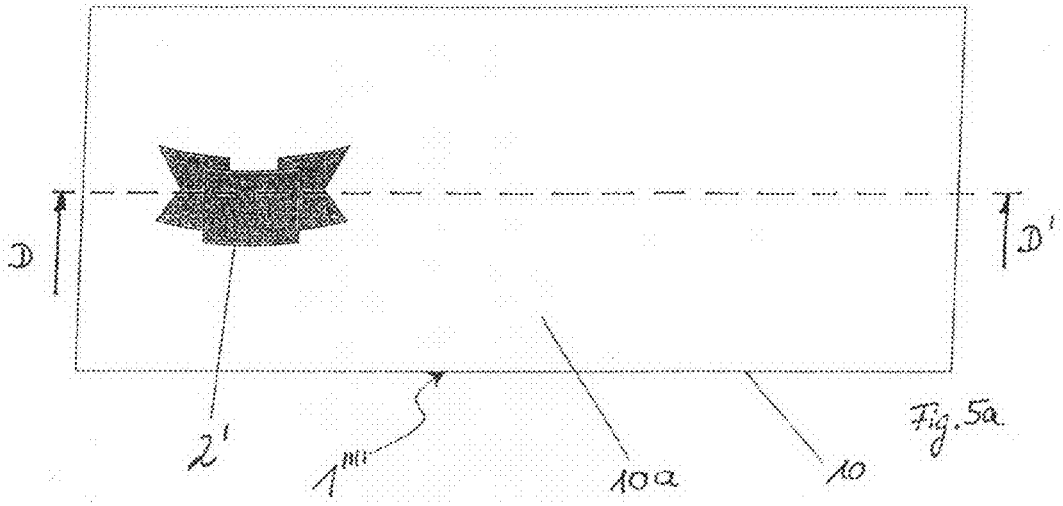
FIG. 5*a* shows a further security document with a security element which in the transillumination mode simulates the presence of a three-dimensional watermark.

FIG. 5*a* shows a further security document 1''' in the form of a deed with a security element 2 (see also FIG. 5*c*) which is embedded in the carrier substrate 10 of light-scattering paper in adjoining relationship with the surface and which in the transillumination mode, viewed from the first side 10*a*, simulates the presence of a three-dimensional watermark 2'. In this case the security element 2 has at least two layers 2*a*', 2*a*" of opaque, blackly coloured lacquer simulating the at least one first watermark (see FIG. 5*d*), the layers being spaced from each other by a spacer layer 5 of plastic film which acts as a filter for light of given angular orientations and which allows the passage therethrough of scattered light only of a given angle range, coming from the second side 10*b*. The two layers 2*a*', 2*a*" simulating the at least one first watermark are respectively provided with openings, the openings being mutually superposed in such a way that in the transillumination mode, depending on the respective viewing angle involved, different regions of the security element 2 allow light to pass therethrough. Thus in the transillumination mode a first three-dimensional representation, here a folded strip, can be seen at a first viewing angle as illustrated in FIG. 5*a*.

Figure 5B:
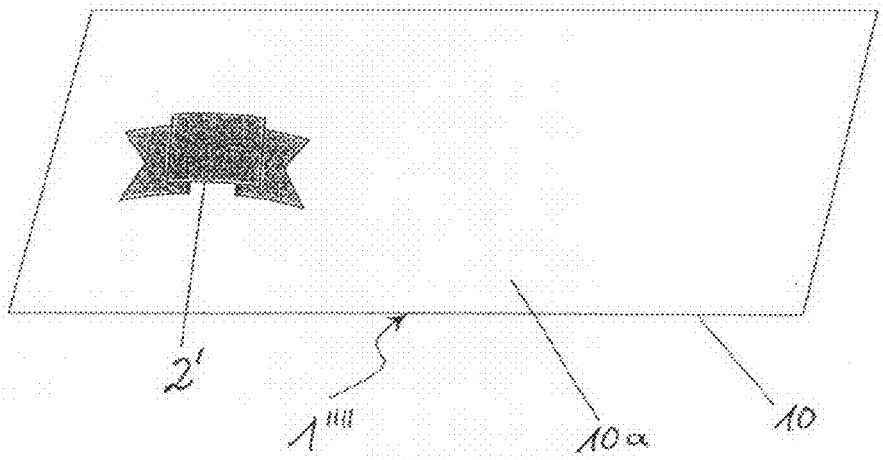
FIG. 5*b* shows the security document of FIG. 5*a* in the transillumination mode but from a different viewing angle.

If as shown in FIG. 5*b* the security document 1''' is viewed from a different viewing angle in the transillumination mode, the three-dimensional strip is shown from a different perspective by virtue of the displacement or change in position of the translucent regions of the three-dimensional strip. In this case the change in perspective can be continuously observed with the change in the viewing angle, or it can take place abruptly.

Figure 5C:
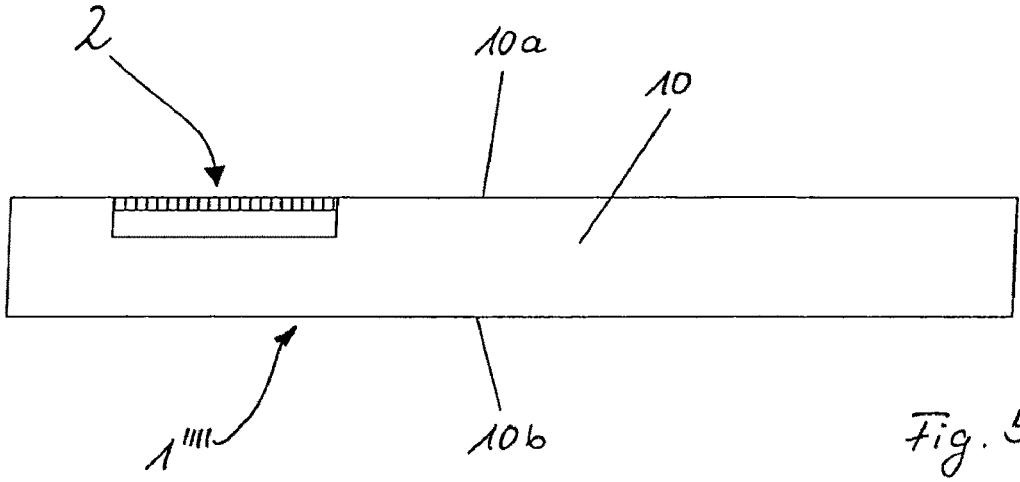
FIG. 5*c* shows a view in cross-section of the security document of FIG. 5*a*.

FIG. 5*c* shows the security document of FIG. 5*a* and the security element 2 embedded in the carrier substrate 10 in cross-section in simplified form.

Figure 5D:
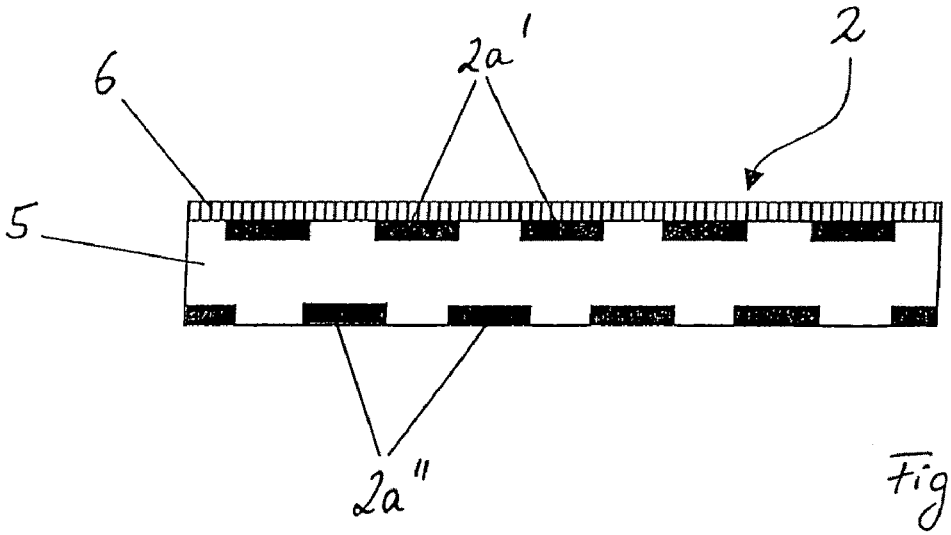
FIG. 5*d* shows an enlarged view of the security document of FIG. 5*c* (same view)

FIG. 5*d* shows the security element 2 of FIG. 5*c* on its own and in cross-section on an enlarged scale. It shows the spacer layer 5 which on each side has a respective one of the layers 2*a*', 2*a*" which simulate the at least one first watermark and which are each provided with openings through which light of a given angular orientation passes, in dependence on the spacer layer 5 acting as a filter. In addition there is an optically variable element 6 in the form of a volume hologram, an amplitude hologram or a diffractive surface structure which can be very clearly seen in the transillumination mode but which can essentially not be recognised in the incident light mode.

Figure 6A:
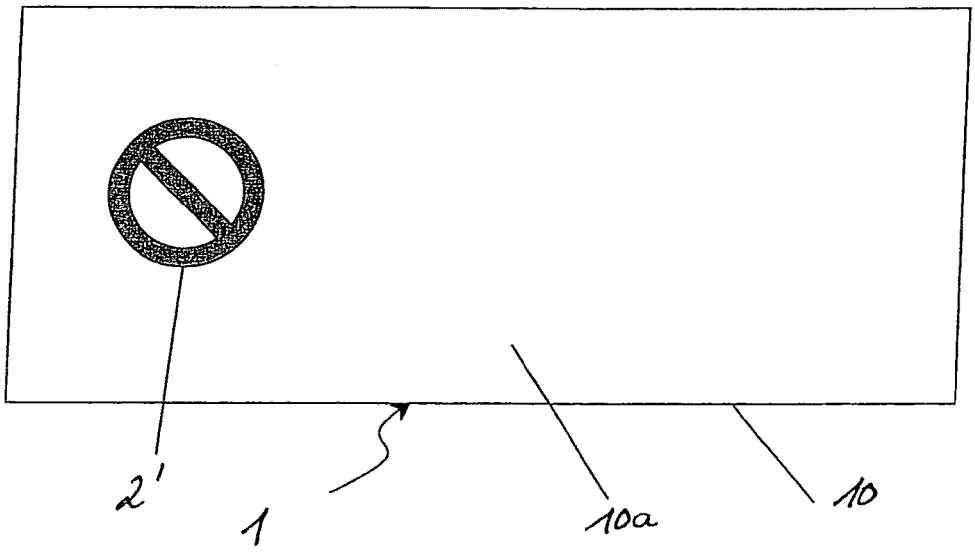
FIG. 6*a* shows a further security document with a security element which in the transillumination mode simulates the presence of a moving watermark.

FIG. 6*a* shows a further security document 1 with a security element which is embedded in a carrier substrate 10 of light-scattering paper in adjoining relationship with the surface and which viewed from the first side 10*a* in the transillumination mode simulates the presence of a moving watermark 2' when the viewing angle is changed. In this case, as already shown in principle in FIGS. 5*a* to 5*d*, the security element has at least two layers which simulate the at least one first watermark and which are arranged spaced from each other by a spacer layer acting as a filter and which are respectively provided with openings, wherein the openings are in mutually superposed relationship in such a way that in the transillumination mode, depending on the respective viewing angle, different regions of the security element allow light to pass. Thus in the transillumination mode the watermark 2' appears in a first representation, here a centrally divided circular ring, at a first viewing angle.

Figure 6B:
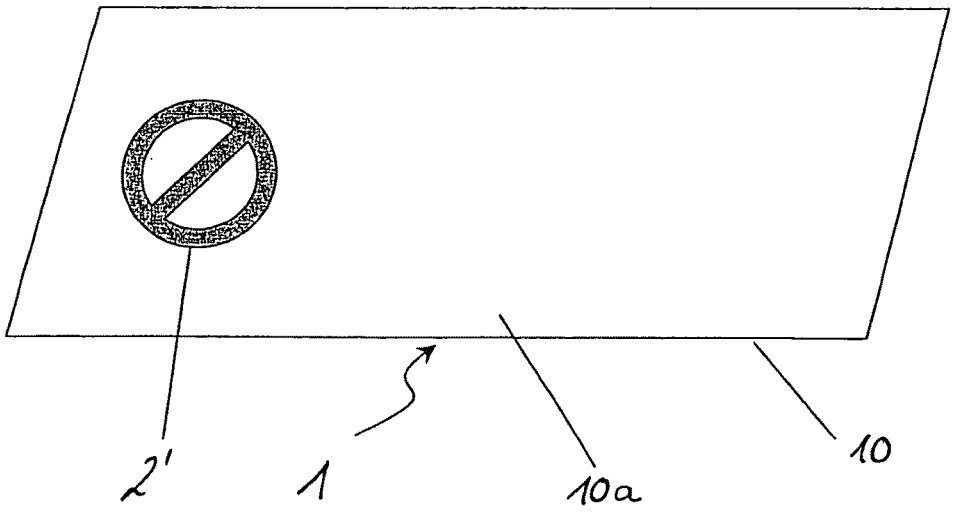
FIG. 6*b* shows the security document of FIG. 6*a* in the transillumination mode but from a different viewing angle.

FIG. 6*b* also shows the security document 1 of FIG. 6*a* in the transillumination mode, but from a different viewing angle. By virtue of the displacement or change in position of the translucent regions the watermark 2' is shown in a second representation or the circular ring is shown in a different spatial orientation. In this respect the change in position of the circular ring with the change in the viewing angle can be observed continuously or can take place abruptly.

Figure 7A:
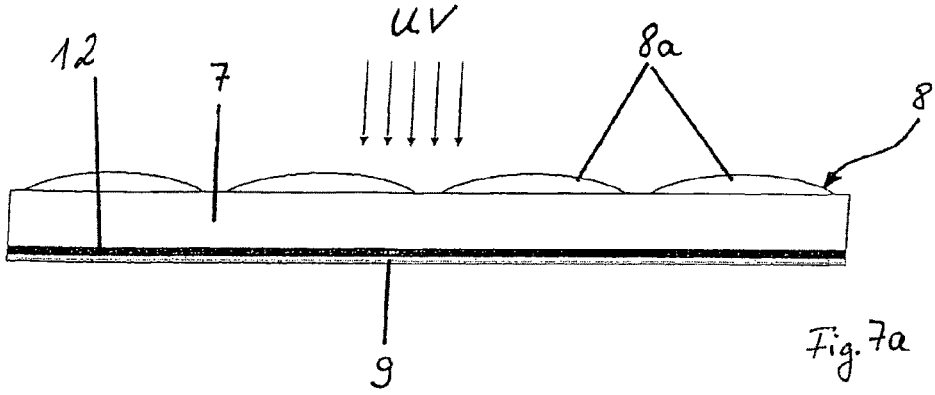
FIG. 7*a* shows the production of a security element for producing a watermark effect visible only on one side of a security document, in cross-section.
Figure 7B:
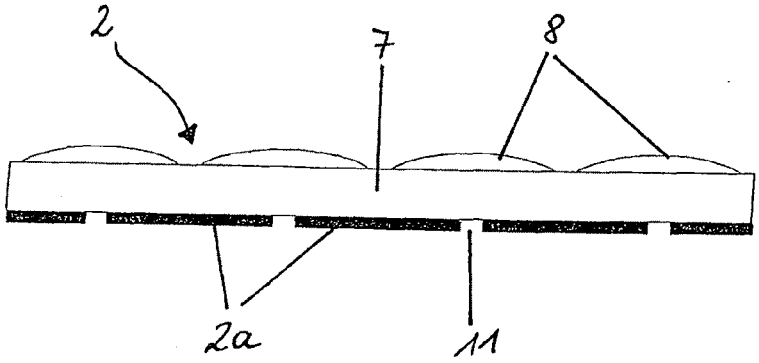
FIG. 7*b* shows a view in cross-section of the security element produced as shown in FIG. 7*a*.

FIG. 7*a* shows the production of a security element 2 as shown in FIG. 7*b* for production of a watermark effect visible only on one side of a security document, in cross-section. A film carrier 7 of transparent PET of a layer thickness in the region of 12 to 50 μm is covered on one side with a UV hardening replication lacquer layer 8 and microlenses 8*a* are replicated therein. The microlenses 8*a* are preferably refractive and are of a thickness or structure depth of usually 2 to 50 μm and are of a diameter (viewed perpendicularly to the plane of the replication lacquer layer 8) of usually 5 to 100 μm. A metal layer 12 of aluminium of a layer thickness of 50 nm is applied over the full surface area to the side of the film carrier 7, that is opposite to the microlenses 8*a*. Information, in particular in the form of a € symbol, is introduced into the metal layer 12. The information is formed by the metal layer 12 which is provided over the full surface area being covered on its side remote from the film carrier 7 with a positive photoresist layer 9. Then UV exposure is effected from the side of the microlenses 8*a* (see the arrows) by way of an exposure mask (not shown here). The UV light is incident on the microlenses 8*a* and is focused or concentrated thereby so that a single light beam leaves the replication lacquer layer 8, per microlens 8*a*. The light beams pass through the film carrier 7 to the metal layer 12 and—by virtue of adequate transmission of the 50 nm thick aluminium layer in relation to UV radiation—through same to the positive photoresist layer 9. The exposed regions of the photoresist layer 9 are then removed in a washing process and the exposed regions of the metal layer 12 are removed by etching. The result is openings 11 in the metal layer, which are oriented in perfect register relationship with the microlenses 8*a*. Finally the photoresist layer 9 is removed and the metal layer 12 which is provided with openings 11 and which has now become a layer 2*a* simulating a first watermark is exposed (see FIG. 7*b*). Alternatively the openings can also be produced in the metal layer by laser ablation, in which case a metal layer of aluminium of a layer thickness of 20 nm or a layer of tellurium of a layer thickness of 50 nm has proved desirable.

FIG. 7*b* shows a view in cross-section of the security element 2 which is produced as shown in FIG. 7*a* and which, embedded in a carrier substrate of a security document, can simulate a watermark with a particularly unusual optical effect.

Figure 7C:
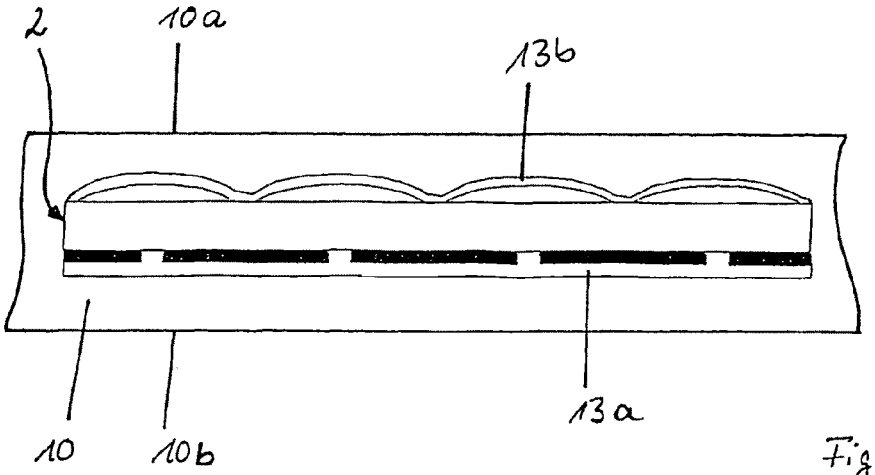
FIG. 7*c* shows the security element of FIG. 7*b* embedded in a security document (in cross-section)

FIG. 7*c* now shows a view in cross-section of the security element 2 of FIG. 7*b*, which was completely embedded into a carrier substrate 10 of a security document of paper and was glued thereto on both sides. The carrier substrate 10 has a comparatively weak scattering action and is thin.

For gluing purposes, on each side of the security element 2 there is a respective transparent adhesive layer 13*a*, 13*b* provided over the full surface area or only partially (for example in the form of a line or dot raster grid). The layer thickness of the adhesive layer 13*b* which is arranged adjoining the microlenses 8*a* is negligibly small in comparison with the structure depth of the microlenses 8*a* so that the optical effect of the security element 2 is not impaired. The adhesive layer 13*a* adjoining the layer 2*a* simulating the first watermark can be substantially thicker. The security element 2 is not visible in the incident light mode either from the first side 10*a* of the carrier substrate 10 or from the second side 10*b*. From the first side 10*a* of the carrier substrate 10, the viewer in the transillumination mode sees a first watermark with a slightly, dynamic motion effect which affords an item of information in the form of a € symbol, as the layer 2*a* simulating the first watermark allows only a part of the incident light to pass through the openings 11. Viewed from the second side 10*b* however, in the transillumination mode, the viewer does not see any watermark as the lenses provide that all incident light is focused and passes through the openings 11. The subsequent material of the carrier substrate 10 scatters or distributes the focused light uniformly before the light reaches the eye of the viewer so that, to the astonishment of the viewer, when seen from the second side 10*b*, it is not possible to perceive any differences in brightness or any watermark in the carrier substrate 10.

Figure 8A:
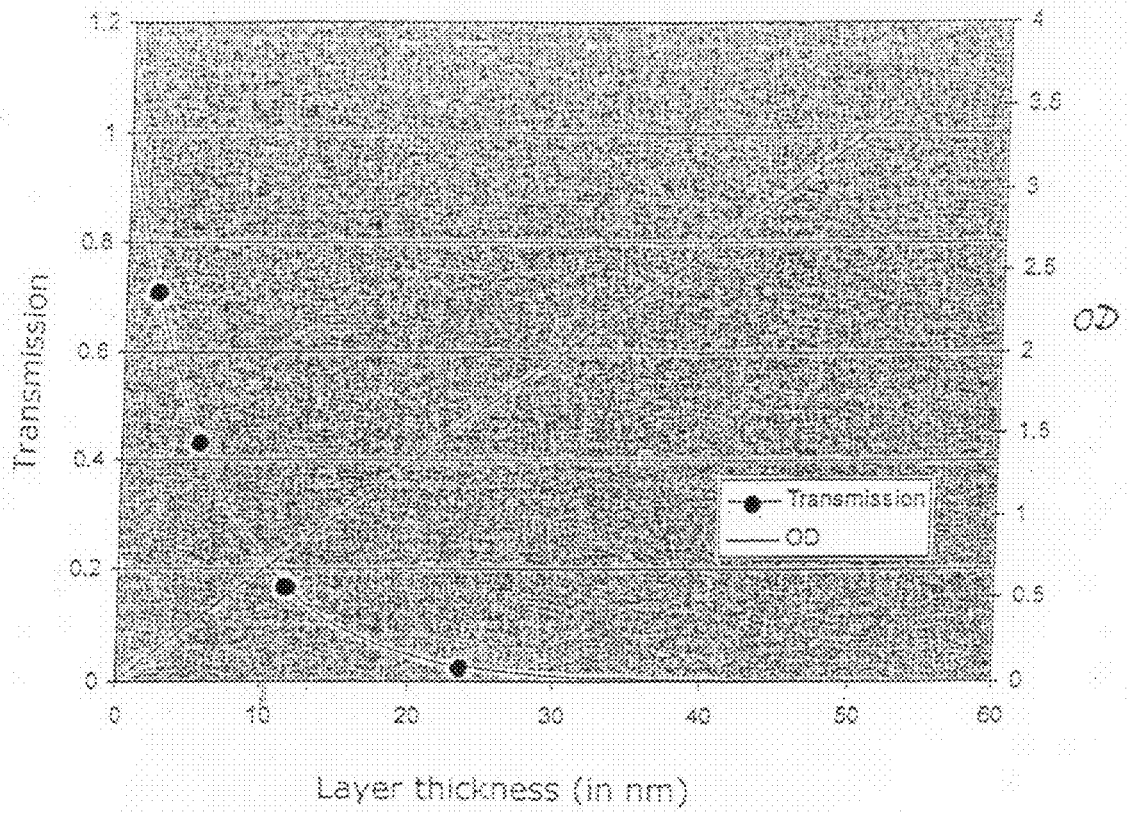
FIG. 8*a* shows a diagram relating to the dependency of transmission or optical density of an aluminium layer on its layer thickness under normal illumination.

FIG. 8*a* shows a diagram relating to the dependency of transmission or optical density OD of an aluminium layer on its layer thickness d (in nm) under normal illumination. The viewer perceives the aluminium layer as translucent if the transmission is greater than 10%, in particular greater than 20%. That is the case for aluminium of a layer thickness of up to about 10 to 15 nm.

Figure 8B:
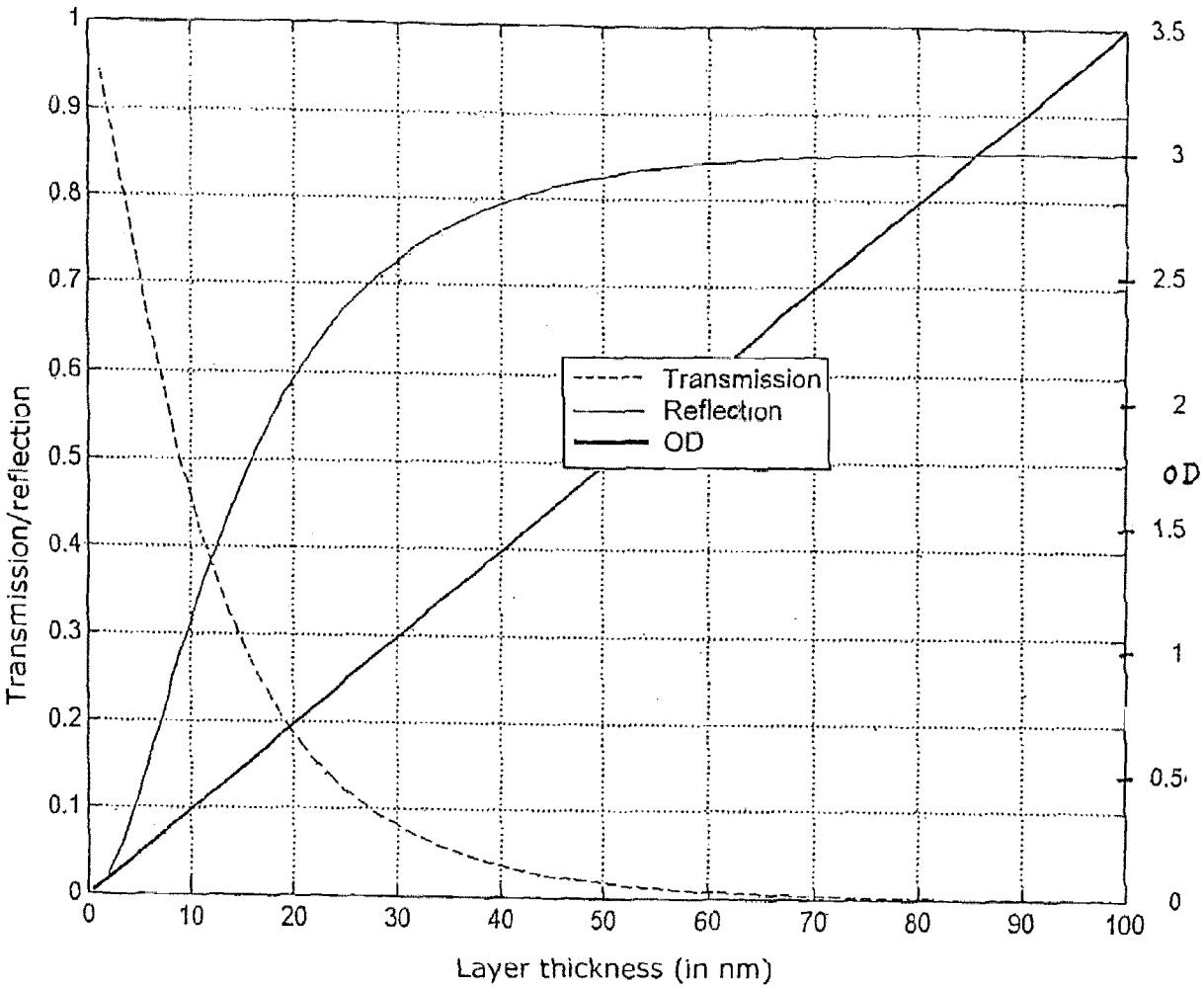

FIG. 8*b* shows a diagram relating to the dependency of transmission/reflection or optical density OD of a silver layer on its layer thickness d (in nm) under normal illumination. The viewer perceives the silver layer as translucent if the transmission is greater than 10%, in particular greater than 20%. That is the case for silver of a layer thickness of up to about 19 to 27 nm.

If a gold layer is used, then with a layer thickness of 40 nm the result is transmission of less than 10%, that is to say an opaque layer.

The described configurations of security elements for the simulation of optically surprising watermarks can be readily arranged in combination with each other on a security document to further enhance the forgery-resistance thereof.

Further embodiments of a security document according to the invention, which are not described in detail here, will be apparent to the man skilled in the art with knowledge of the invention.

The invention claimed is:

1. A security document comprising a translucent carrier substrate of paper and/or plastic material, and at least one security element which is applied to the carrier substrate or embedded in the carrier substrate and which presents at least one image when viewed in a transillumination mode from at least a first side of the security document and simulates a presence of at least a first watermark in the carrier substrate, wherein the security element has at least region-wise at least one layer which simulates the at least one first watermark and which locally alters the visually perceptible translucence of the carrier substrate, and wherein the at least one security element applied to the carrier substrate or embedded in the carrier substrate visually perceptibly in the transillumination mode shows a third image different from the first image viewed from a second side opposite to the first side, wherein the security document is so adapted that between the at least one layer simulating the at least one first watermark and the first side and between the at least one layer simulating the at least one first watermark and the second side the light passing therethrough is scattered to differing degrees such that the third image comprises the first image plus regions of high translucency, said regions of high translucency not being visible when the first image is visible when viewing the security document in the transillumination mode from the first side of the security document.

2. A security document according to claim 1, wherein at least one security element applied to the carrier substrate or embedded in the carrier substrate visually perceptibly shows a second image different from the first image in the incident light mode.

3. A security document according to claim 2, wherein the layer simulating the at least one first watermark has regions of different transmissivity.

4. A security document according to claim 3, wherein the security element is applied on the second side of the security document.

5. A security document according to claim 3, wherein the security element is embedded in the translucent carrier substrate in such a way that the security element is disposed in a plane parallel to the first side and the second side and a region of the carrier substrate which is on the second side between the at least one layer simulating the watermark and a viewer is at least partially cut out, wherein regions, visible from the second side, of the layer simulating the first watermark are to be visually recognized in the incident light mode as closed opaque layer regions, but at least the visible regions of the layer simulating the first watermark are differently transmissive in the transillumination mode.

6. A security document according to claim 2, wherein the at least one layer simulating the watermark, when viewed in the incident light mode, presents a different surface extent than can be perceived in the transillumination mode.

7. A security document according to claim 6, wherein the layer simulating the first watermark is applied on the second side of the security document and is covered region-wise by at least one translucent color layer arranged on the second side.

8. A security document according to claim 6, wherein the layer simulating the first watermark is embedded in the translucent carrier substrate in such a way that the security element is disposed in a plane parallel to the first side and the second side and a region of the carrier substrate which is on the second side between the at least one layer simulating the watermark and a viewer is either partially cut out or however entirely cut out and covered region-wise by at least one translucent color layer arranged on the second side, wherein the regions, visible from the second side, of the layer simulating the first watermark are to be recognized in the incident light mode visually as opaque layer regions which are shaped out region-wise and which show an item of security information, and in the transillumination mode from the second side there shows the at least one first watermark which differs from the item of security information.

9. A security document according to claim 1, wherein the at least one layer simulating the first watermark is respectively covered at least partially on the first side and a second side opposite the first side of the security document by at least one translucent layer, wherein the at least one translucent layer on the first side and the at least one translucent layer on the second side scatter incident light to differing degrees.

10. A security document according to claim 9, wherein the security element is arranged on the second side and the layer simulating the watermark is covered by at least one translucent color layer arranged on the second side.

11. A security document according to claim 9, wherein the security element is embedded into the translucent carrier substrate in such a way that the security element is disposed in a plane parallel to the first side and the second side but at an unequal spacing relative to the first side and the second side, or the security element is embedded in the translucent carrier substrate and the layer simulating the watermark is covered by at least one translucent color layer arranged on the first side and/or the second side, wherein the layer simulating the first watermark when viewed from the second side in the transillumination mode shows at least one second image which simulates a presence of at least one second watermark different from the first watermark in the carrier substrate.

12. A security document according to claim 1, wherein the at least one security element applied to the carrier substrate or embedded in the carrier substrate visually perceptibly shows at least one fourth image different from the first image when viewed in the transillumination mode from the first side or a second side opposite to the first side in dependence on the viewing angle.

13. A security document according to claim 12, wherein the at least one layer simulating the first watermark has regions of a transmissivity dependent on the viewing angle.

14. A security document according to claim 13, wherein the at least one first watermark in the transillumination mode shows a kinematic effect and/or a three-dimensional effect and/or a color change effect upon tilting of the security document at least on one side of the security document.

15. A security document according to one of claim 7, wherein the at least one translucent color layer does not substantially differ in color from adjoining regions of the translucent carrier substrate.

16. A security document according to claim 1, wherein the at least one layer simulating the first watermark has transparent regions and/or openings whose dimensions, at least in one direction, are below the resolution limit of the human eye of about 0.3 mm.

17. A security document according to claim 1, wherein the at least one layer simulating the first watermark has transparent regions and/or openings, wherein the mean surface density of the transparent regions and/or openings in the layer which is opaque in the incident light mode is less than 10%.

18. A security document according to claim 1, wherein the at least one layer simulating the first watermark has regions of differing layer thickness.

19. A security document according to claim 18, wherein the at least one layer simulating the first watermark is at least region-wise of a continuously changing layer thickness.

20. A security document according to claim 18, wherein the at least one layer simulating the first watermark is at least region-wise of a stepwise changing layer thickness.

21. A security document according to claim 1, wherein the at least one layer simulating the first watermark has transparent regions and/or openings in such a way that the at least one layer simulating the first watermark is structured in the form of a microscopically fine dot or line raster.

22. A security document according to claim 21, wherein the least one layer simulating the first watermark is structured in the form of an aperiodic dot or line raster.

23. A security document according to claim 21, wherein the regions forming the dot or line raster of the at least one layer simulating the first watermark are provided in substructured fashion in at least region-wise manner.

24. A security document according to claim 1, wherein the security element has at least two layers which are arranged in mutually overlapping relationship in at least region-wise manner and which simulate the first watermark.

25. A security document according to claim 24, wherein, in the transillumination mode, the transmissivity which is dependent on the viewing angle and/or a coloration which is dependent on the viewing angle can be perceived in the overlap region of the at least two layers simulating the first watermark upon tilting of the security document.

26. A security document according to claim 24, wherein the at least two layers simulating the first watermark are respectively structured in the form of a microscopically fine dot or line raster which in the overlap region present a periodic moire pattern.

27. A security document according to claim 1, wherein the security element has an optically variable effect which is visible when viewing in the incident light mode.

28. A security document according to claim 1, wherein the security element has an optically variable pigment, a liquid crystal material, a luminescent material or a thermochromic material, and/or a diffractive structure.

29. A security document according to claim 1, wherein the security element has at least one transparent layer which adjoins the at least one layer simulating the first watermark and in which a diffractive relief structure is shaped.

30. A security document according to claim 29, wherein the transparent layer has a multiplicity of microlenses wherein a layer thickness of the at least one transparent layer at least approximately corresponds to the focal length of the microlenses.

31. A security document according to claim 24, wherein the security element has at least two layers simulating the first watermark and at least one translucent color layer and/or a transparent layer, containing diffractive relief structures, is arranged between them.

32. A security document according to claim 31, wherein the transparent layer is colored.

33. A security document according to claim 1, wherein the at least one layer simulating the first watermark is provided by at least one metal layer and/or at least one dielectric layer and/or at least one chalcogenide glass layer and/or at least one pigmented layer, in particular a pigmented color layer or ink, and/or a liquid crystal layer.

34. A security document according to claim 33, wherein the at least one layer simulating the first watermark is formed from a combination of at least one metal layer and at least one pigmented layer.

35. A security document according to claim 1, wherein the carrier substrate is provided with a translucent security imprint thereon.

36. A security document according to claim 35, wherein the security imprint includes colored material and/or magnetic material and/or electrically conducting material and/or optically variable material.

37. A security document according to claim 1, wherein the security element is formed by a lamination film or a transfer layer portion of a transfer film.

38. A security document according to claim 1, wherein the security document is a banknote, a bank card, an ID card, a pass, a passport, a value-bearing paper or a deed.

39. A security document according to claim 1, wherein the at least one layer comprises a plurality of image dots arranged in a grid, said image dots varying in thickness in the plane of the at least one layer to form regions of differing translucency in said first image and said third image when respectively viewed in the transillumination mode from the first and second sides of the security document.

40. A security document according to claim 1, wherein the at least one layer comprises a plurality of strips forming said first and third images.

41. A security document according to claim 40, wherein at least two of said plurality of strips have different grey tones, whereby said first and third images are half-tone or grey scale images.

42. A security document according to claim 40, wherein said plurality of strips have regions varying in thickness in the plane of the at least one layer to form regions of differing translucency in said first image and said third image when respectively viewed in the transillumination mode from the first and second sides of the security document.

43. A security document according to claim 40, wherein said regions of high translucency comprise filigree lines of high translucency extending generally perpendicular to said plurality of strips.

44. A security document according to claim 18, wherein said regions of differing layer thickness form areas of differing translucency in said first image and said third image when respectively viewed in the transillumination mode from the first and second sides of the security document.

* * * * *

UNITED STATES PATENT AND TRADEMARK OFFICE

CERTIFICATE OF CORRECTION

PATENT NO. : 8,403,368 B2
APPLICATION NO. : 12/449459
DATED : March 26, 2013
INVENTOR(S) : Tompkin et al.

It is certified that error appears in the above-identified patent and that said Letters Patent is hereby corrected as shown below:

In the Specification

Column 18, line 40 now reads "security document 1''' in the form"

should read -- security document 1'''' in the form --

Column 18, line 61 now reads "security document 1''' is viewed"

should read -- security document 1'''' is viewed --

Signed and Sealed this
Third Day of September, 2013

Teresa Stanek Rea

Teresa Stanek Rea
*Acting Director of the United States Patent and Trademark Office*

UNITED STATES PATENT AND TRADEMARK OFFICE

CERTIFICATE OF CORRECTION

PATENT NO. : 8,403,368 B2
APPLICATION NO. : 12/449459
DATED : March 26, 2013
INVENTOR(S) : Tompkin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 858 days.

Signed and Sealed this
First Day of September, 2015

Michelle K. Lee

Michelle K. Lee
*Director of the United States Patent and Trademark Office*